US007229147B2

(12) United States Patent
Hasebe et al.

(10) Patent No.: US 7,229,147 B2
(45) Date of Patent: Jun. 12, 2007

(54) INK JET PRINTER

(75) Inventors: Takashi Hasebe, Hachioji (JP); Saburo Shimizu, Hachioji (JP); Tetsu Sekine, Hachioji (JP); Shuta Hamada, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 345 days.

(21) Appl. No.: 10/926,268

(22) Filed: Aug. 26, 2004

(65) Prior Publication Data

US 2005/0151763 A1 Jul. 14, 2005

(30) Foreign Application Priority Data

Jan. 13, 2004 (JP) ..... 2004-005338
Jan. 14, 2004 (JP) ..... 2004-006961
Feb. 24, 2004 (JP) ..... 2004-048076

(51) Int. Cl.
*B41J 29/393* (2006.01)

(52) U.S. Cl. ..... 347/19; 347/14

(58) Field of Classification Search ..... None
See application file for complete search history.

(56) References Cited

U.S. PATENT DOCUMENTS 5,422,664 A * 6/1995 Stephany ..... 347/14
6,209,981 B1 * 4/2001 Hirano ..... 347/7
6,527,358 B2 3/2003 Kuriyama et al.
2003/0030688 A1 2/2003 Kuriyama et al.
2004/0252151 A1 * 12/2004 Higuchi et al. ..... 347/19
2005/0122360 A1 * 6/2005 Sakagami et al. ..... 347/19

* cited by examiner

*Primary Examiner*—Thinh Nguyen
(74) *Attorney, Agent, or Firm*—Finnegan, Henderson, Farabow, Garrett & Dunner, L.L.P.

(57) ABSTRACT

An ink jet printer has an ink jet section for jetting ink from nozzles, a vibration detection section for detecting a jet failure of the nozzles, which is provided ahead in an ink droplet jetting direction from the nozzles, an ink droplet receiving section for receiving an ink droplet jetted from the nozzles, which is interposed between the nozzles and the vibration detection section, and a control section for controlling a maximum diameter of an ink droplet jetted from the nozzles when detecting a jet failure of the nozzles to be larger than that when recording an image.

31 Claims, 27 Drawing Sheets

FIG.23

143a

| ADDRESS | | DATA |
|---|---|---|
| A1 | A2 | |
| 01 × | 0000 | |
| 01 × | 0001 | DETECTED DATA IN CLK1 |
| 01 × | 0002 | DETECTED DATA IN CLK2 |
| 01 × | 0003 | DETECTED DATA IN CLK3 |
| ⋮ | | ⋮ |
| 02 × | 0000 | |
| 02 × | 0001 | DETECTED DATA IN CLK1 |
| 02 × | 0002 | DETECTED DATA IN CLK2 |
| 02 × | 0003 | DETECTED DATA IN CLK3 |
| ⋮ | | ⋮ |

INK JET PRINTER

BACKGROUND OF THE INVENTION

1. Field of the Invention

The present invention relates to a detection of a jet failure of a nozzle in an ink jet printer.

2. Description of the Related Art

In an earlier developed ink jet printer, an image is recorded by jetting ink droplets onto a recording medium from a plurality of nozzles which use a thermal system or a piezo system actuated according to jet signals based on image signals. In the ink jet printer, fixing of ink near nozzle jet openings or adhering of impurities (foreign particles) or the like to the nozzle jet openings due to drying or increased viscosity of ink in a case of being left for a long period of time without being used would cause clogging of the nozzles, which results in a failure of jetting ink droplets from the nozzle jet openings in spite of normally outputting ink jet signals from a drive circuit unit, that is, a jet failure of ink from the nozzles (hereinafter, referred as nozzle clogging). The nozzle clogging would cause a deterioration of print quality such as generating a blank in a printed character or image, which is recognized as a white stripe, or causing difference of reproduced color in each recorded image due to a lack of ink color material. Therefore, an optical detection section as a detection section for detecting such the nozzle clogging is disclosed.

For example, disclosed is an ink jetting condition detection method for detecting nozzle clogging by changing a detection timing with a photo sensor in which light emitting elements and light receiving elements are combined along a distance corresponding to the width of the head as a detection section of nozzle clogging of a carriage type ink jet printer in which ink is jetted from a head in a direction (main scanning direction) perpendicularly crossing a carrying direction of a paper (sub scanning direction) to form an image (JP-Tokukai-hei-11-188853A, hereinafter referred as "Patent Document 1").

However, applying Patent Document 1 to a line head type ink jet printer could be causative factors of cost increase due to the needs to adjust the amount of light or the diameter of beam from the light emitting elements with high accuracy because one line head has a large length and the size of the ink droplets jetted from the nozzles is small, and to move the detection section for nozzle clogging by using a positioning sensor with high accuracy. Also, the distance between the light emitting elements and the light receiving elements becomes large, which may cause misdetection due to dust or ink droplets in the form of mist. Further, since a large number of nozzles which need to be detected exist in one line head, it would raise a problem that time for detection become long.

SUMMARY OF THE INVENTION

The present invention is developed in view of the above described problems, and an object of the present invention is to provide an ink jet printer capable of precisely detecting nozzle clogging by utilizing impact force generated when an ink droplet jetted from a nozzle lands.

For solving the problems, in accordance with an aspect of the present invention, the ink jet printer comprises: an ink jet section for jetting ink from nozzles; a vibration detection section for detecting a jet failure of the nozzles, which is provided ahead in an ink droplet jetting direction from the nozzles; an ink droplet receiving section for receiving an ink droplet jetted from the nozzles, which is interposed between the nozzles and the vibration detection section; and a control section for controlling a maximum diameter of an ink droplet jetted from the nozzles when detecting a jet failure of the nozzles to be larger than that of an ink droplet jetted from the nozzles when recording an image.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 23 is an example of a memory map 143*a* stored in a storing unit 143;

DETAILED DESCRIPTION OF THE PREFERRED EMBODIMENTS

[First Embodiment]

Figure 1:
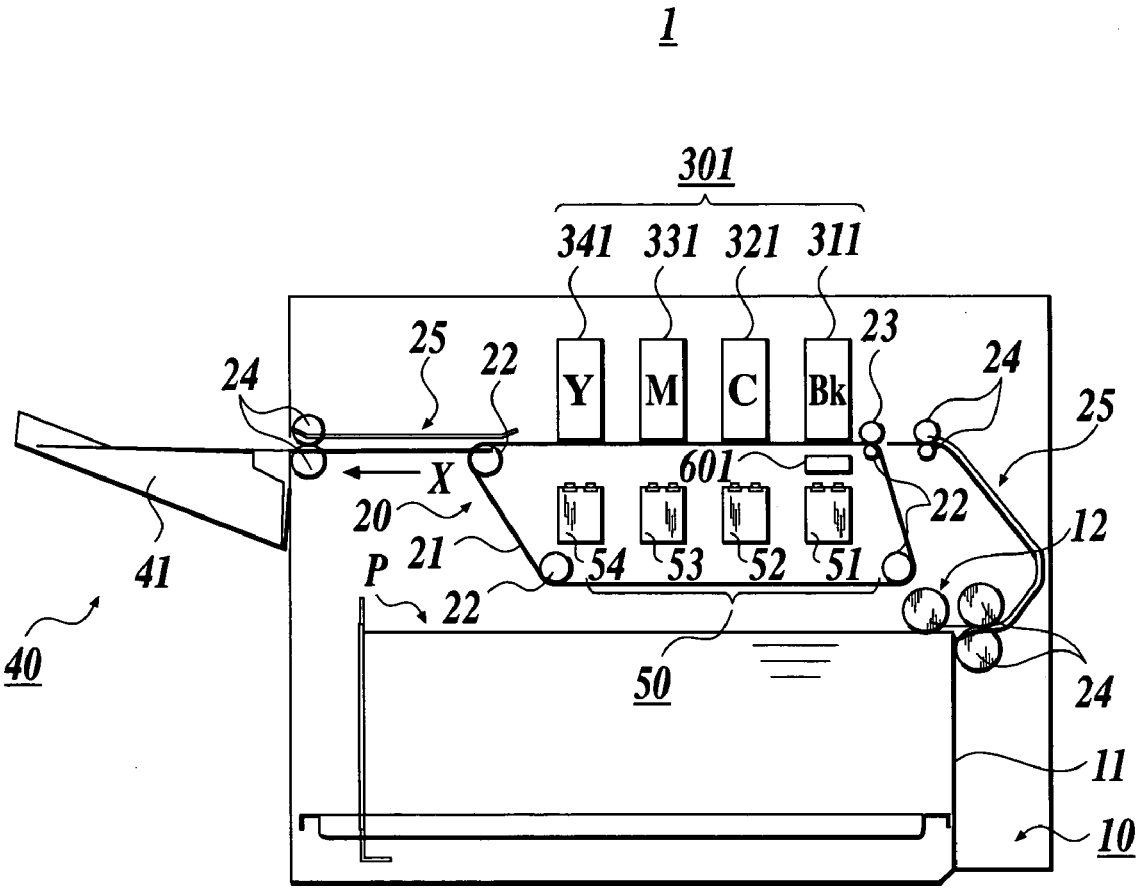
FIG. 1 is a schematic view of an inside of a line head type ink jet printer 1 in the first embodiment.

The first embodiment of the present invention will be explained below referring to the drawings.

The configuration will be explained first.

FIG. 1 shows a schematic view of the inside of an ink jet printer 1 of a line head type in the first embodiment. As shown in FIG. 1, the ink jet printer 1 comprises a paper feed part 10, a carrying part 20, a head unit part 301, a paper discharge part 40, a maintenance part 50 as a maintenance section, a nozzle clogging detection part 601 and the like.

The paper feed part 10 is provided with a paper feed tray 11 for stacking and storing a plurality of recording mediums P at the lower side of the inside of the ink jet printer 1. A paper pick up device 12 is provided at one end portion of an upper side of the paper feed tray 11 for picking up the recording medium P on which an image is to be recorded one by one from the paper feed tray 11.

The recording medium P to be applied includes various types of papers such as a plain paper, a recycled paper, a gloss paper or the like, and a cut sheet shaped recording medium made from a material such as various types of textiles, non-woven fabrics, resin, metal, glass or the like.

The carrying part 20 for carrying the recording medium P is provided on the upper side of the paper feed part 10. The carrying part 20 comprises a carrying belt 21, tension rollers 22, a pressure roller 23, carrying rollers 24, and a carrying path 25.

The carrying belt 21 is a circular shaped belt for carrying the recording medium P in a horizontal direction while supporting it in a plane state, and is movably tensioned by the plurality of tension rollers 22. The carrying belt 21 is provided with an opening part 21*a*, so that a nozzle clogging detection part 601 to be described later is movable and a capping module covers nozzle jet openings. There are provided an encoder film and an encoder sensor at the end portion of the carrying belt 21 to enable the opening part 21*a* to be positioned at the lower side of the nozzle jet openings when judging nozzle clogging or performing a maintenance operation, thereby the position of the opening part 21*a* can be detected based on the detection signal from the encoder sensor (not shown).

The pressure roller 23 is rotatably provided at a portion where the carrying belt 21 and the recording medium P start to contact with each other as a roller to put pressure onto the carrying belt 21 for carrying the recording medium P in a flat shape.

The carrying path 25 is a path for discharging the recording medium P which was fed from the paper feed tray 11 and carried along the periphery of the carrying belt 21 to a paper discharge part 40. The carrying rollers 24 are provided at a predetermined position of the carrying path 25 as a plurality pairs of rollers for carrying the recording medium P in a carrying direction X.

A head unit part 301 comprises line head type unit heads 311, 321, 331, 341 at the portion near the upper portion of the carrying belt 21, for jetting each ink color of black (Bk), cyan (C), magenta (M) and yellow (Y) onto the recording medium P in this order along the carrying direction X, each of which comprises a plurality of nozzle jet openings (not shown) and extends along the whole width of the carrying belt 21. Each head unit 311, 321, 331, 341 is disposed to make the nozzle-plates thereof face the periphery of the carrying belt 21.

The recording medium P on which an image is formed by ink droplets jetted from each head unit 311, 321, 331, 341 is discharged from the paper discharge part 40 in order.

Each head unit 311, 321, 331, 341 extending in a direction approximately perpendicular to the carrying direction X of the recording medium P comprises a plurality of head modules as an ink jet section arranged in parallel in a longitudinal direction. Each head module extends in the longitudinal direction of each head module 311, 321, 331, 341, and they are alternately arranged in parallel with each other at predetermined intervals in the carrying direction X of the recording medium P (staggered arrangement).

In the head modules in the first embodiment, the plurality of nozzle jet openings are disposed in an inline arrangement, and ink droplets can be jetted from the adjacent nozzle jet openings at the same time.

Figure 2A:
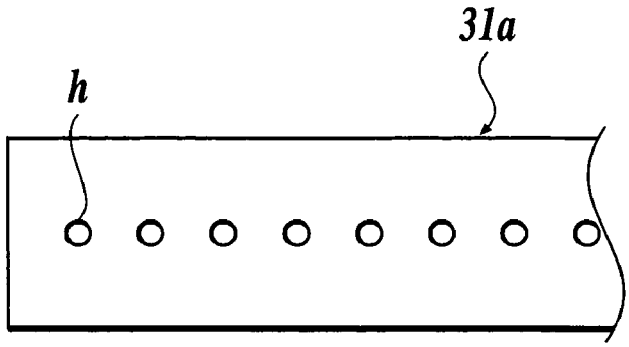
FIG. 2A is an example of a front view of a nozzle-plate side of a head module 31*a;*
Figure 2B:
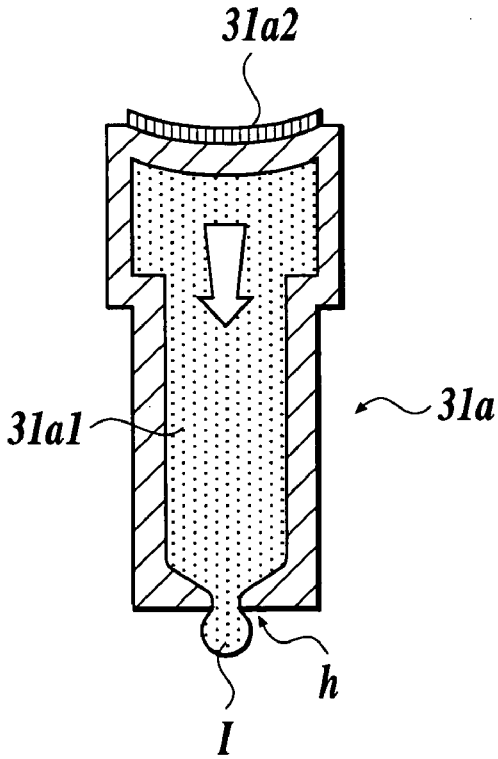
FIG. 2B is an example of a sectional view of the head module 31*a;*

FIG. 2A is an example of a front view of the nozzle-plate side of a head module 31*a*, and FIG. 2B is an example of a sectional view of a channel of the head module 31*a*.

As shown in FIG. 2A, the head module 31*a* comprises a plurality of nozzle jet openings h which are disposed in an inline arrangement in the longitudinal direction of the head module.

As shown in FIG. 2B, the channel of the head module 31*a* comprises a nozzle jet opening h, an ink chamber 31*a*1, a piezoelectric element 31*a*2 provided at the upper side of the ink chamber 31*a*1. A plurality of such channels is arranged on the head module 31*a*.

When an ink jet signal is applied to the piezoelectric element 31*a*2 through an electrode (not shown), the upper wall of the ink chamber 31*a*1 bends downward, so that the pressure of the inside of the ink chamber 31*a*1 is raised to jet ink from the nozzle jet openings h. Each channel can jet ink droplets with an independent timing by individually giving a signal to the piezoelectric element.

The paper discharge part 40 comprises a paper discharge tray 41 provided at the side portion of the ink jet printer 1, and the recording medium P on which an image is formed is discharged therefrom in order.

The maintenance part 50 is provided at the lower side of the head unit 301 to face thereto across a portion near the lower portion of the upper surface of the carrying belt 21. The maintenance part 50 comprises a plurality of cap units 51, 52, 53, 54 for covering the nozzle jet openings, a suction pump which is not shown, and a waste ink tank.

Each cap unit 51, 52, 53, 54 comprise a plurality of capping modules (not shown), each of which corresponds to each head module of each head unit 311, 321, 331, 341. Each capping module is movable between a capping position for capping the nozzle jet openings of each head module corresponding thereto and a separated position where each capping module is separated from the nozzle jet openings. Coupled to each capping module is a suction pump and an air communicating valve or the like for suctioning fluid in a space which is formed after each capping module is moved to the capping position and the whole nozzle jet openings are covered by a rubber member or the like to shutter off the outside air and be sealed. That is, the air and the ink inside the space are suctioned by the suction pump. The ink suctioned by the suction pump is discharged to the waste ink tank. The configurations of the suction pump, the air communicating valve, the waste ink tank and the like are same as those of the earlier technique, therefore the detailed descriptions thereof are omitted here.

In the first embodiment, explanation will be made to an example, in which a suction operation which is a representative of a maintenance method is adopted as a method to solve nozzle clogging. However, a flashing operation may be adopted, in which electrical signals are given to the heads to jet ink droplets, and foreign materials or the like adhered to the nozzle jet openings and the nozzle-plates are flashed.

Further, a mechanism for performing a wiping operation to wipe unnecessary ink droplets adhered to the nozzle-plates after the suction operation or the flashing operation may be provided.

The nozzle clogging detection part 601 is provided at the lower portion of the head unit part 301 to face thereto across the portion near the lower portion of the upper surface of the carrying belt 21, and is movable to the predetermined position corresponding to each head unit 311, 321, 331, 341. A plurality of nozzle clogging detection parts 601 extends in the longitudinal direction of the head units and is alternately arranged in parallel with each other at predetermined intervals in the carrying direction X of the recording medium P, to correspond to each head module.

Figure 3B:
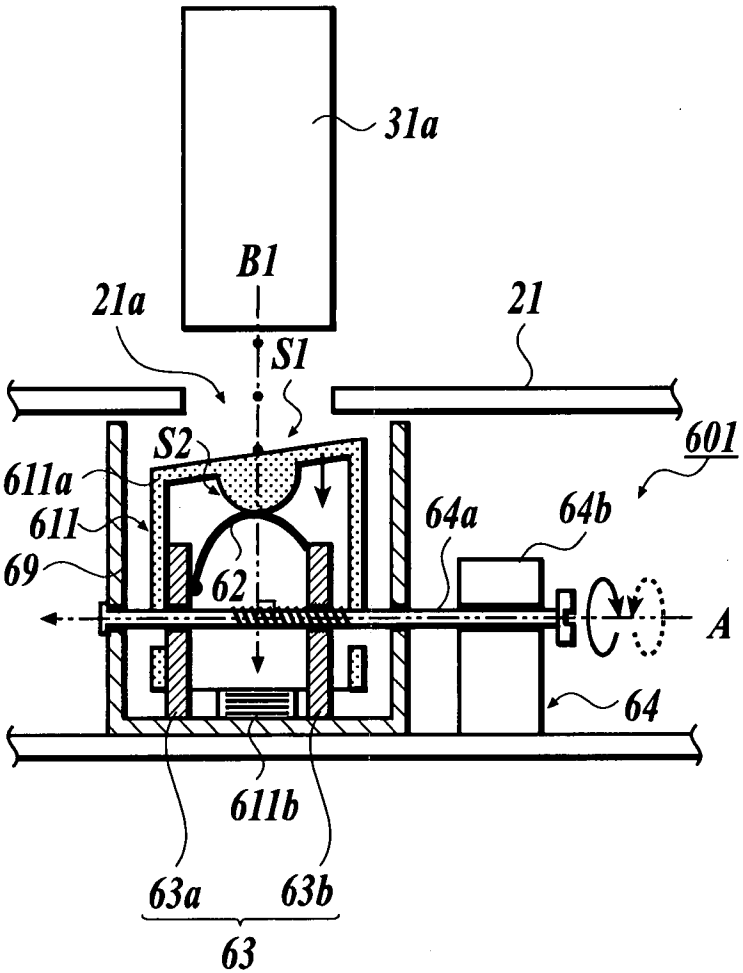
FIG. 3B is an end view of the nozzle clogging detection part 601 in an operating state in the first embodiment.
Figure 3A:
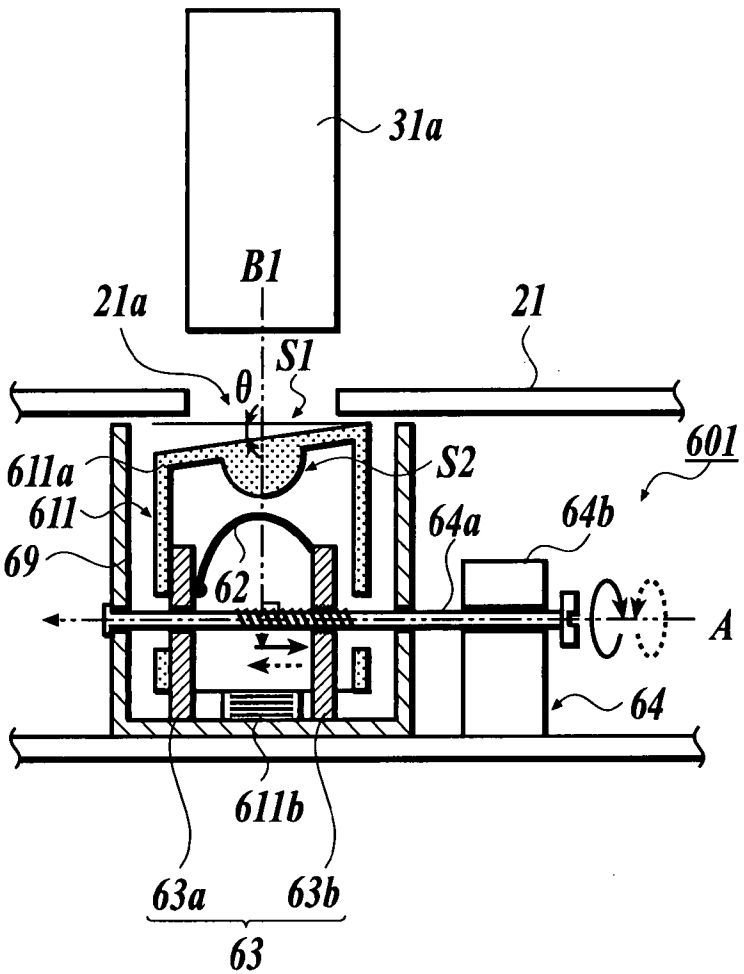
FIG. 3A is an end view of a nozzle clogging detection part 601 in an initial state in the first embodiment.

FIGS. 3A and 3B show end views of the nozzle clogging detection part 601.

FIG. 3A shows a state where the nozzle clogging detection part 601 has not received an ink droplet from the head module 31*a* (initial state), and FIG. 3B shows a state where the nozzle clogging detection part 601 has received an ink droplet from the head module 31*a* (operating state).

As shown in FIGS. 3A and 3B, the nozzle clogging detection part 601 comprises an ink droplet receiving part 611 as an ink droplet receiving section, a piezo film 62 as an film like piezoelectric element, which is a vibration detection section, a supporting part 63 as a position adjusting section, an adjusting part 64 and the like.

The ink droplet receiving part 611 comprises a cover 611*a* and an elastic supporting member 611*b*, and transmits the impact force generated when ink droplets land to the piezo film 62.

The cover 611*a* comprises an ink droplet landing surface S1 for receiving ink droplets and a contact surface S2 for transmitting the impact force by contacting with the piezo film 62 when ink droplets land on the ink droplet landing surface S1. The contact surface S2 is provided with a projecting portion at a position to face the maximum projecting portion of the curved outer periphery of the piezo film 62 for transmitting the impact force generated when ink droplets land to the maximum projecting portion.

Figure 4A:
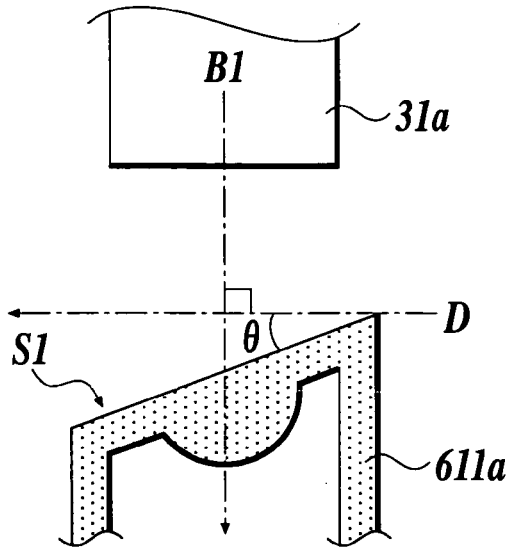
FIG. 4A is a schematic end view of an ink droplet landing surface S1 of a cover 611*a;*
Figure 4B:
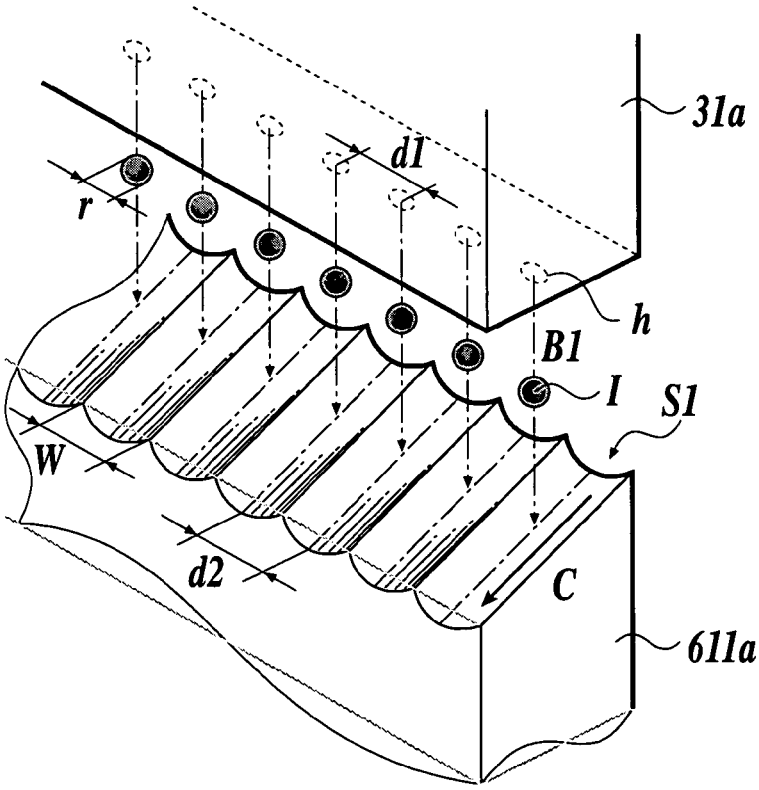
FIG. 4B is a perspective view of an example of a plurality of channels formed on the ink droplet landing surface S1 of the cover 611*a;*

FIGS. 4A and 4B show the ink droplet landing surface S1 of the cover 611*a*.

FIG. 4A shows a schematic end view of the ink droplet landing surface S1 of the cover 611*a*, and FIG. 4B shows a perspective view of an example of a plurality of channels formed on the ink droplet landing surface S1.

As shown in FIG. 4A, the ink droplet landing surface S1 is inclined at the predetermined tilt angle θ in one direction with respect to a direction D which is perpendicular to an ink droplet jetting direction B1 of an ink droplet I which is the same as the vertical direction.

As shown in FIG. 4B, a plurality of channels is formed to be parallel to one another on the ink droplet landing surface S1 for receiving the ink droplet I from the nozzle jet openings h. In the nozzle clogging detection, the maximum diameter r of the ink droplet I is larger than that in the image recording and not larger than the width w of the channel. Each channel is opened on one end side in an longitudinal direction, and is inclined such that the opened portion at one end side in the longitudinal direction is positioned lower than the other end side in the vertical direction (that is, ink droplet jetting direction B1). The arrangement pitch of the channels d2 (hereinafter, referred as channel pitch) is formed to be equal to that of the nozzles (hereinafter, referred as nozzle pitch) d1.

The cover 611*a* on which the channels are formed is provided such that a bottom portion of each channel corresponds to a position on which the ink droplet I jetted from each nozzle jet opening h lands.

Providing such channels is successful in discharging the ink droplet I without positively removing the ink droplet I landed onto the ink droplet landing surface S1 because the ink droplet I runs off along the inclination direction C of the channels every time the ink droplet I lands. Therefore, the impact force generated when the ink droplet I lands can be detected with high accuracy, enabling to improve judgment accuracy of a jet failure of the nozzles.

Since the channel pitch d2 is equal to the nozzle pitch d1, the channels each of which corresponds to each nozzle jet opening h can be formed. Thus, the ink droplet can be efficiently discharged. Also, since the bottom portion of each channel corresponds to a position onto which the ink droplet I lands, it can be prevented that the ink droplet I hits the upper end of the channels to disperse. Thus, the ink droplet I can be efficiently discharged. Moreover, the impact force generated when the ink droplet I lands can be efficiently received by the cover 611*a*.

The channels in the invention are effective in the ink jet printer in which ink with relatively low viscosity in room temperature such as oil-based ink or water-based ink. Further, as a method for improving the effect, for example, in the ink jet printer in which water-based ink is used, the ink can be effectively removed by performing water repellent treatment to the surface of the cover 611*a* on which ink droplets land.

The shape of cross section of each channel in the first embodiment may be a curved shape other than an approximately semicircle shown in FIG. 4B, and the shape is not limited thereto as long as a shape is capable of efficiently discharging ink droplets and is easily formed.

The cover 611*a* extends in the longitudinal direction of the head module corresponding thereto to be interposed between the nozzles and the piezo film 62, so that the piezo film 62 can be protected from various ink droplets. Thus, the response property of the piezo film 62 can be protected. Specifically, in the ink jet printer in which a property (viscosity) of the ink to be jetted is changed depending upon the ink used, there is a case where the ink is heated to the temperature higher than room temperature, and the ink droplets with high temperature are detected. In such the ink, the temperature of the piezo film rises after receiving tens of ink droplets, which would cause a change to the response property of the piezo film. Thus, the cover 611*a* has a purpose to prevent such the change of the response property. When the ink to be used is electrically conductive ink, the cover 611*a* can prevent the piezo film from being damaged when the electrically conductive ink contacts the output signal terminals of the piezo film.

The cover 611*a* is kept in resting state by the elastic supporting member 611*b* provided on the bottom portion, and transmits small impact force generated when the ink droplets land onto the piezo film 62, so that it is preferable to use workpiece materials which are light in weight such as plastic or the like and can be formed to be an arbitrary shape.

The elastic supporting member 611*b* supports the cover 611*a* to keep the contact surface S2 of the cover 611*a* and the piezo film 62 in a non-contact state when the ink droplet landing surface S1 does not receive ink droplets, and to make the contact surface S2 of the cover 611*a* be in the contact state with the piezo film 62 when the ink droplet landing surface S1 receives ink droplets.

In the first embodiment, when the ink droplet landing surface S1 does not receive ink droplets, the contact surface S2 and the piezo film 62 are set to be in the non-contact state, however, both of them may contact with each other, that is, the present invention is not limited to this embodiment so long as the piezo film 62 and the contact surface S2 are in a stationary state while keeping a certain equilibrium state.

The piezo film 62 is curved into an approximately half cylinder ahead in the ink droplet jetting direction by the support part 63, and is supported to make the maximum projecting portion of the curved outer periphery direct to an ink droplet coming direction. The piezo film 62 extends corresponding to the longitudinal direction of the head module.

In the present invention, the landing of ink droplets is detected by using piezoelectric effect of the piezo film 62. To further improve sensitivity and directivity of the piezo film 62, the piezo film 62 is curved into an approximately half cylinder, and ink droplets from the ink droplet coming direction land onto the maximum projecting portion of the curved outer periphery (that is, the maximum projecting portion of the piezo film 62 which is curved into an approximately half cylinder contacts with the projecting portion of the contact surface S2).

The piezo film 62 used in the invention may be any piezoelectric element as long as the piezoelectric element is formed in a film shape, which is easy to thin even when it has a large size, with piezoelectric effect and improved productivity, having excellent flexibility, impact-resistance, chemical stability or the like in comparison with an earlier developed piezoelectric ceramic or the like, and has a better output response to impact or shape changing, wide frequency characteristic or the like.

Figure 5A:
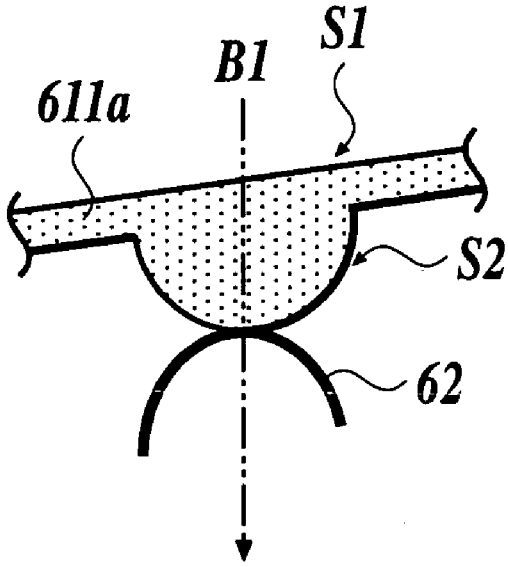
FIG. 5A is a view in which a maximum projecting portion of a contact surface S2 of the cover 611*a* contacts with a maximum projecting portion of a piezo film 62.
Figure 5B:
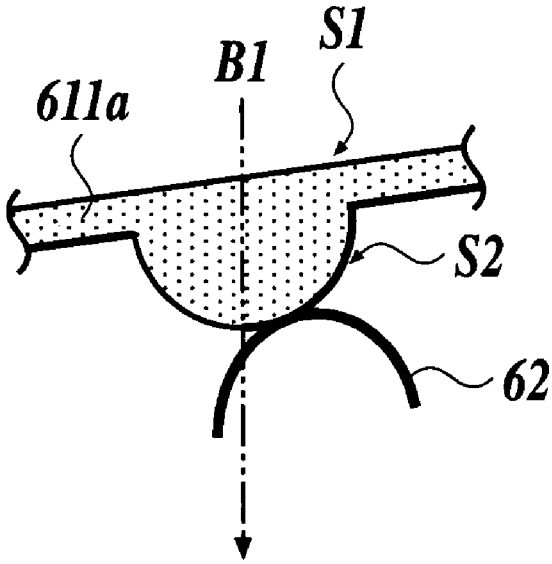
FIG. 5B is a view in which the contact surface S2 of the cover 611*a* contacts with the piezo film 62.

FIGS. 5A and 5B show sectional views of an example of a contact state of the contact surface S2 of the cover 611*a* and the piezo film 62. FIG. 5A shows a state that the maximum projecting portion of the contact surface S2 of the cover 611*a* having a projecting portion contacts with the maximum projecting portion of the piezo film 62, and FIG. 5B shows a state that the contact surface S2 of the cover 611*a* contacts with the piezo film 62.

As shown in FIG. 5A, in the case where the maximum projecting portion of the cover 611*a* contacts with the maximum projecting portion of the curved outer periphery of the piezo film 62, when ink droplets from the nozzle jet openings land on the ink droplet landing surface S1, a small impact force generated by the landing of the ink droplets onto the ink droplet landing surface S1 can be concentrated on the maximum projecting portion of the contact surface S2, thereby enabling the maximum projecting portion of the piezo film 62 to receive the impact force. Thus, the impact force by the ink droplets can efficiently be transmitted, so that high sensitivity and response property can be obtained.

As shown in FIG. 5B, in the case where the contact surface S2 contacts with the piezo film 62 at portions other than the maximum projecting portions, the impact force by the landing of ink droplets on the ink droplet landing surface S1 would be dispersed, and further the dispersed impact force would be received by the curved surface of the piezo film 62, thereby reducing the transmission efficiency of the force, which results in lowering the sensitivity and response property.

Thus, the position of the maximum projecting portion of the curved outer periphery of the piezo film 62 is adapted to be movable, and the nozzle clogging detection part 601 comprises the supporting part 63 and the adjusting part 64 for adapting the maximum projecting portion to the ink droplet landing position. Adaptation of the maximum projecting portion of the curved outer periphery of the piezo film 62 to the ink droplet landing position is successful in adjusting the shape of the piezo film, thereby enabling to adjust the response property of the piezo film 62.

As shown in FIGS. 3A and 3B, the supporting part 63 curves the piezo film 62 into approximately half cylinder to support it. The supporting part 63 comprises a fixed supporting part 63*a* and a movable supporting part 63*b*. The facing surfaces of the fixed supporting part 63*a* and the movable supporting part 63*b* are provided to be perpendicular to a rotating axis A of a screw 64*a* which will be described later and in parallel with each other.

The piezo film 62 is fixed to the fixed supporting part 63*a* at one end side thereof in a curving direction, and the fixed supporting part 63*a* is provided not to move irrespective of the rotation of the screw 64*a*.

The movable supporting part 63*b* supports the other end side of the piezo film 62 opposing to the one end side of the piezo film 62 in the curving direction which is fixed to the fixed supporting part 63*a*. A female screw hole in which a male screw part of the screw 64*a* is screwed is formed in the movable supporting part 63*b*, so that the movable supporting part 63*b* is movable to be close to or separated from the fixed supporting part 63*a* corresponding to the rotation direction of the screw 64*a*.

The adjusting part 64 comprises the screw 64*a* and a supporting base 64*b*.

The screw 64*a* is disposed such that the rotating axis A of the screw 64*a* is perpendicular to the ink droplet jetting direction B1, and is rotatably supported by the supporting base 64*b* and a casing 69. The screw 64*a* has the male screw part in a movable rage of the movable supporting part 63*a*, which is screwed in the female screw hole of the movable supporting part 63*a*.

For example, in FIG. 3A, when the screw 64*a* is rotated in a right-handed screw direction, the movable supporting part 63*b* is moved to the right side, and when the screw 64*a* is rotated in a left-handed screw direction, the movable supporting part 63*b* is moved to the left side.

Accordingly, the other end side of the piezo film 62 can be movably supported to be close to or separated from the one end of the piezo film 62 in the curving direction, and the position of the maximum projecting portion of the curved outer periphery is adapted to the ink droplet landing position, so that the position of the maximum projecting portion of the curved outer periphery can be adjusted right to left and up and down. Therefore, the adjustment of the response property of the piezo film 62 can be realized.

Figure 6:
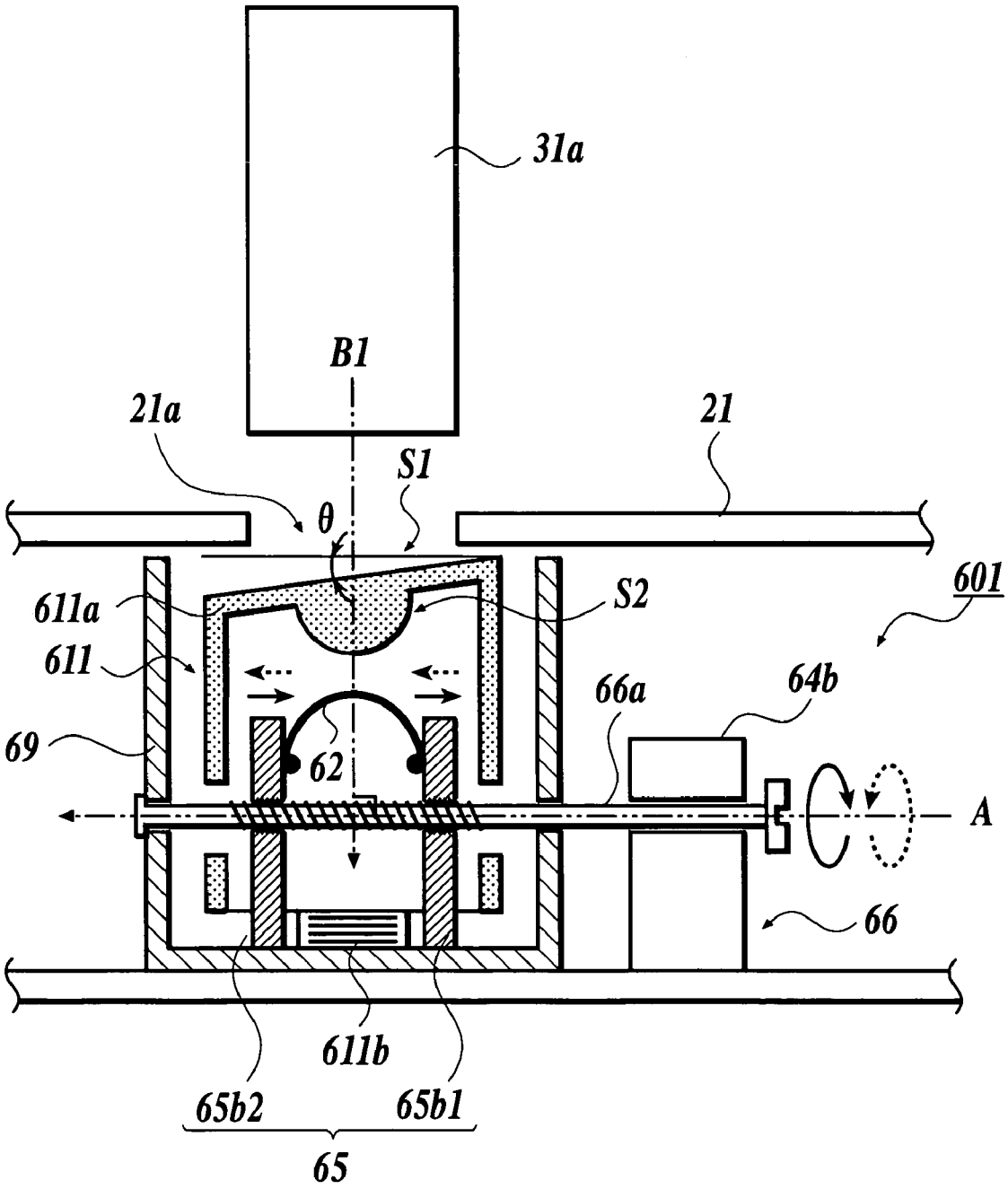
FIG. 6 is an end view of an example 1 of the nozzle clogging detection part 601 shown in FIG. 3A.
Figure 7:
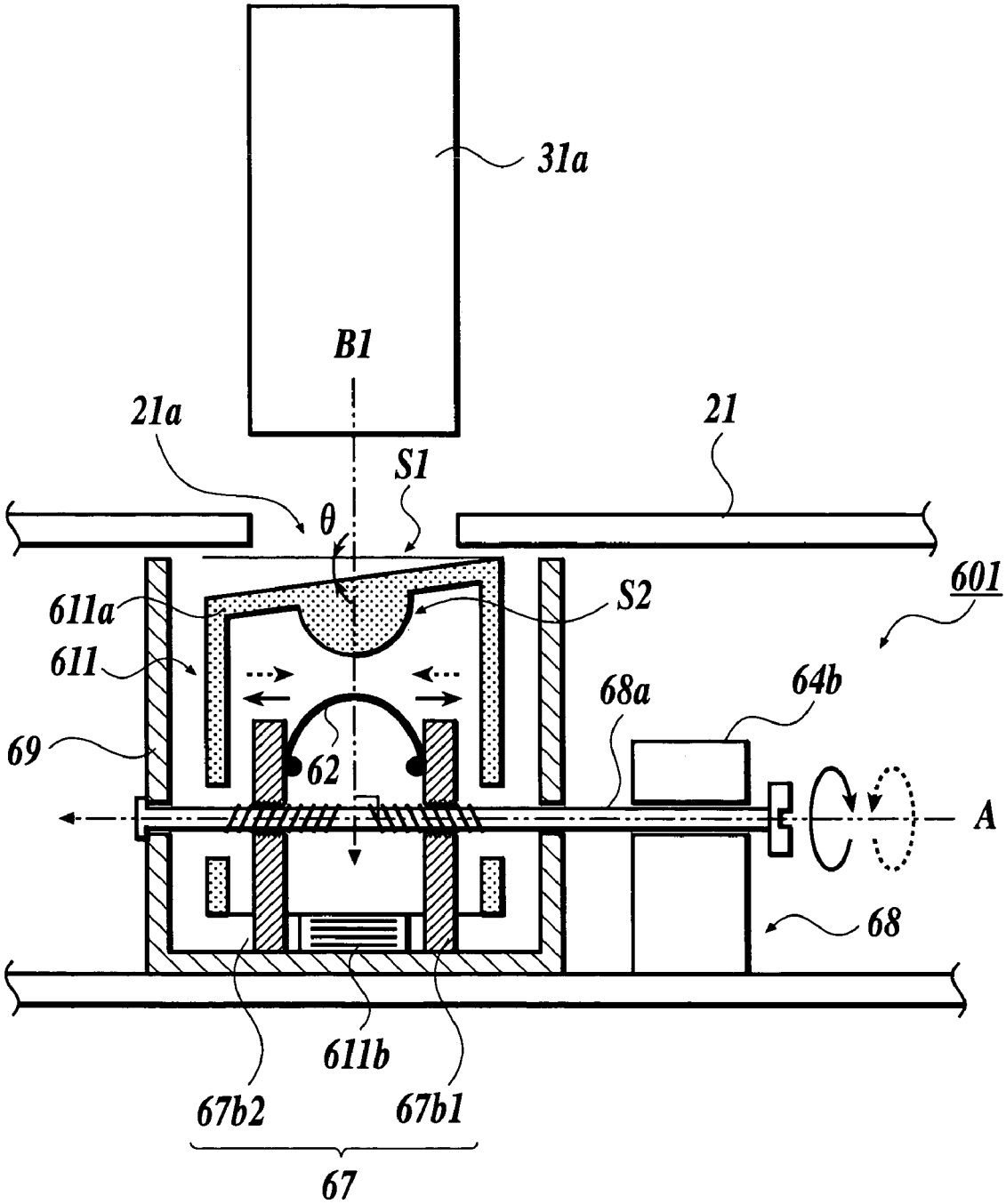
FIG. 7 is an end view of an example 2 of the nozzle clogging detection part 601 shown in FIG. 3A.

FIGS. 6 and 7 show end views of other examples 1 and 2 of the nozzle clogging detection part 601 shown in FIGS. 3A and 3B.

The nozzle clogging detection part 601 shown in FIGS. 6 and 7 has a configuration same as that in FIGS. 3A and 3B excluding supporting parts 65, 67 and adjusting parts 66, 68 respectively provided instead of the supporting part 63 and the adjusting part 64, therefore the explanations thereof are omitted here.

The supporting part 65 shown in FIG. 6 curves the piezo film 62 into approximately half cylinder and support it. The supporting part 65 comprises a first movable supporting part 65*b*1 and a second movable supporting part 65*b*2. The facing surfaces of the first movable supporting part 65*b*1 and the second movable supporting part 65*b*2 are provided to be perpendicular to a rotating axis A of a screw 66*a* which will be described later and in parallel with each other with an interval therebetween kept constant.

The piezo film 62 is fixed to the first movable supporting part 65*b*1 at one end side thereof in the curving direction, and a female screw hole in which a male screw part of the screw 66*a* to be described later is screwed is formed in the first movable supporting part 65*b*, so that the first movable supporting part 65*b*1 is reciprocatingly movable in the direction of the rotating axis A corresponding to the rotation direction of the screw 66*a*.

The other end side of the piezo film 62 opposing to the one end side thereof in the curving direction which is fixed to the first movable supporting part 65*b*1 is fixed to the second movable supporting part 65*b*2. A female screw hole in which the male screw part of the screw 66*a* is screwed is formed in the second movable supporting part 65*b*2, so that the second movable supporting part 65*b*2 is reciprocatingly movable in the direction of the rotating axis A corresponding to the rotation direction of the screw 66*a*.

The adjusting part 66 comprises the screw 66*a* and the supporting base 64*b*.

The screw 66*a* is disposed such that the rotating axis A of the screw 66*a* is perpendicular to the ink droplet jetting direction B1, and is rotatably supported by the supporting base 64*b* and the casing 69. The screw 66*a* has the male screw part in a movable rage of the first and the second movable supporting parts 65*b*1, 65*b*2, which is screwed in the female screw holes.

The first and the second movable supporting parts 65*b*1, 65*b*2 are moved in parallel in the same direction according to the direction of rotating axis A of the screw 66*a* with an interval therebetween kept constant.

For example, in FIG. 6, when the screw 66*a* is rotated in a right-handed screw direction, the first and the second movable supporting parts 65*b*1, 65*b*2 are moved in parallel to the right side with an interval therebetween kept constant, and when the screw 66*a* is rotated in a left-handed screw direction, the first and the second movable supporting part 65*b*1, 65*b*2 are moved in parallel to the left side.

Accordingly, the one end side of the piezo film 62 in the curving direction and the other end side thereof opposing to the one side can be supported to be movable in parallel in the same direction with an interval therebetween kept constant, and the position of the maximum projecting portion of the curved outer periphery is adapted to the ink droplet landing position, so that the position of the maximum projecting portion of the curved outer periphery can be adjusted right to left without changing the curved shape of the piezo film. Therefore, the adjustment of the response property of the piezo film 62 can be realized.

The supporting part 67 shown in FIG. 7 curves the piezo film into approximately half cylinder and support it. The supporting part 67 comprises a first movable supporting part 67*b*1 and a second movable supporting part 67*b*2. The facing surfaces of the first movable supporting part 67*b*1 and the second movable supporting part 67*b*2 are provided to be perpendicular to the rotating axis A of a screw 68*a* which will be described later and in parallel with each other.

The piezo film 62 is fixed to the first movable supporting part 67*b*1 at one end side thereof in the curving direction, and a female screw hole in which a male screw part of the screw 68*a* to be described later is screwed is formed in the first movable supporting part 67*b*1, so that the first movable supporting part 67*b*1 is movable in the direction of the rotating axis A to be relatively close to or separated from the second movable supporting part 67*b*2 corresponding to the rotation direction of the screw 68*a*.

The other end side of the piezo film 62 opposing to the one end side thereof in the curving direction which is fixed to the first movable supporting part 67*b*1 is fixed to the second movable supporting part 67*b*2. A female screw hole in which a male screw part of the screw 68*a* is screwed is formed in the second movable supporting part 67*b*2, so that the second movable supporting part 67*b*2 is movable in the direction of the rotating axis A to be relatively close to or separated from the first movable supporting part 67*b*1 corresponding to the rotation direction of the screw 68*a*.

The adjusting part 68 comprises the screw 68*a* and the supporting base 64*b*.

The screw 68*a* is disposed such that the rotating axis A of the screw 68*a* is perpendicular to the ink droplet jetting direction B1, and is rotatably supported by the supporting base 64*b* and the casing 69. The screw 68*a* has male screw parts in movable rages of the first and second movable supporting part 67*b*1, 67*b*2, respectively, to oppose each other, and each male screw part is screwed in each female screw hole. The first and the second movable supporting parts 67$b$1, 67$b$2 are moved to be relatively close to or separated from each other corresponding to the direction of the rotating axis A of the screw 68$a$.

For example, in FIG. 7, when the screw 68$a$ is rotated in a right-handed screw direction, the first and the second movable supporting parts 67$b$1, 67$b$2 are moved in a direction to be separated from each other, and when the screw 68$a$ is rotated in a left-handed screw direction, the first and the second movable supporting parts 617$b$1, 67$b$2 are moved to be close to each other.

Accordingly, the one end side of the piezo film 62 in the curving direction and the other end side thereof opposing to the one end can be supported to relatively move to be close to or separated from each other, and the position of the maximum projecting portion of the curved outer periphery is adapted to the ink droplet landing position, so that the position of the maximum projecting portion of the curved outer periphery can be adjusted up to down by changing the curved shape of the piezo film. Therefore, the adjustment of the response property of the piezo film 62 can be realized.

As described above, by providing the supporting part 63, 65, 67 and the adjusting part 64, 66, 68, the curvature of the curved piezo film 62 can be changed to adjust the position of the maximum projecting portion of the curved outer periphery, thus, the distance between the cover 611$a$ and the piezo film 62, and the initial shape of the piezo film 62 can be adjusted. Accordingly, in the initial state, appropriate adjustment of the position can be performed so as not to output a signal from the piezo film 62 by some impact (operating vibration of the machine itself, a misalignment of the setting position of the ink receiving member 601, or the like). Appropriate adjustment of the position of the piezo film 62 to the ink droplet landing position is successful in obtaining high response property in the operating state, so that the changes of the landing of fine ink droplets can be detected with high accuracy.

The rotating operation of the screws 64$a$, 66$a$, 68$a$ by the adjusting part 64, 66, 68 may be performed manually or automatically. In the case of automatically performing the rotating operation, for example, a feed screw mechanism may be applied, in which a ball screw or the like is used as the screws 64$a$, 66$a$, 68$a$ in the adjusting part 64, 66, 68. That is, for example, in the case of adjusting the initial shape of the piezo film 62, the configuration is such that the value of rotation amounts corresponding to shape of the piezo film 62 is prestored in the nonvolatile memory which is under the control of the CPU, and the driving force from the drive source which can be controlled by the predetermined control device can be transmitted to the screws 64$a$, 66$a$, 68$a$. Thus, the driving force from the drive source can be controlled based on the stored data in the nonvolatile memory. Thereby, the rotation amount can be automatically adjusted to adjust the position of the maximum projecting portion of the curved outer periphery, so that the initial shape of the piezo film 62 can be adjusted.

Figure 8:
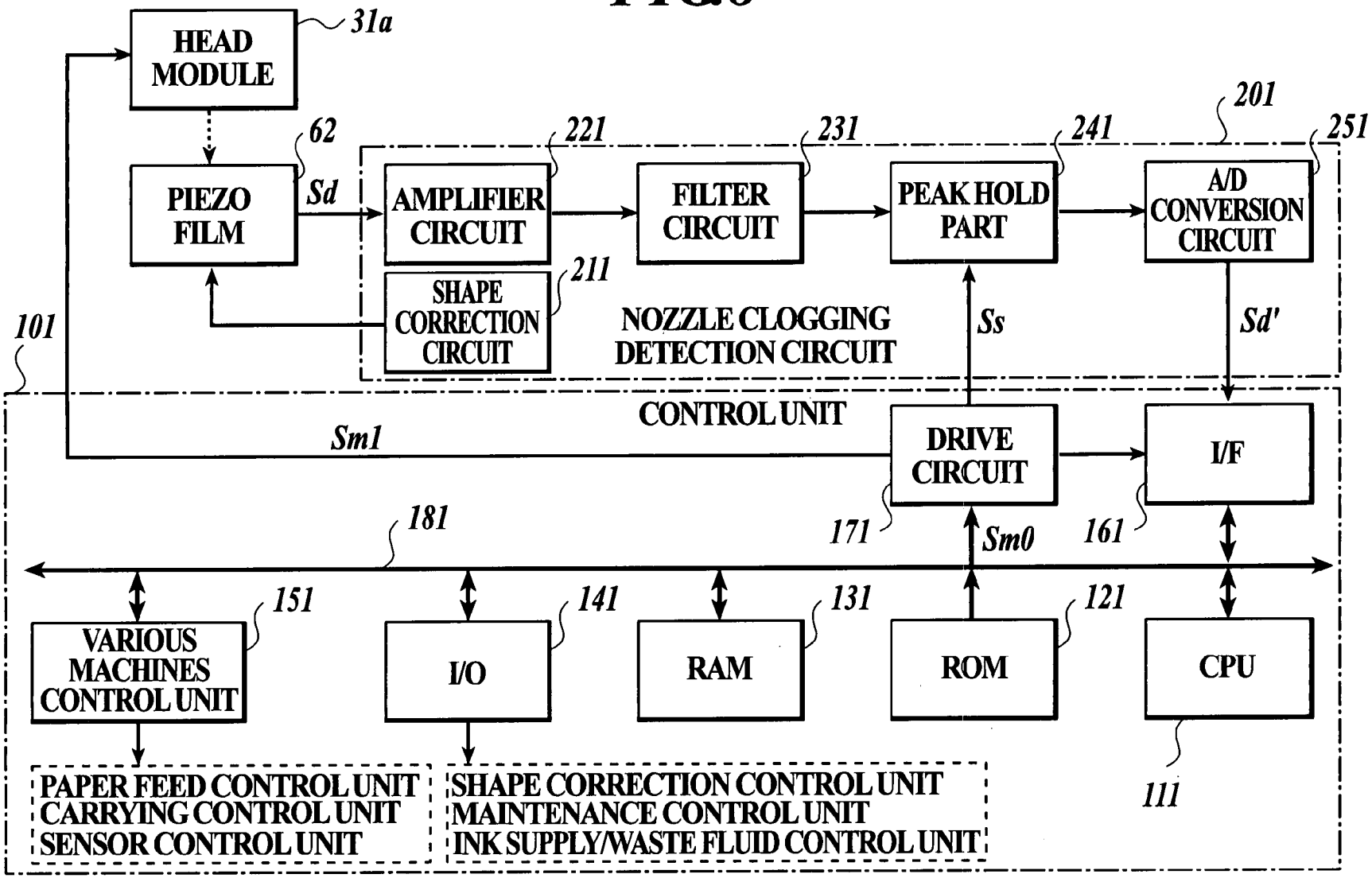
FIG. 8 is a control block diagram for controlling the ink jet printer 1 in the first embodiment.

FIG. 8 shows a control block diagram for controlling the ink jet printer 1 of the first embodiment. As shown in FIG. 8, the control system comprises a control unit 101 and a nozzle clogging detection circuit 201.

In the control unit 101, a CPU (Central Processing Unit) 111 as a judging section, a ROM (Read Only Memory) 121, a RAM (Random Access Memory) 131, an I/O (Input/Output) 141, a various machines control unit 151, an I/F 161, a drive circuit 171 and the like are connected to a system bus 181, and the control unit 101 is connected to the nozzle clogging detection circuit 201 through the I/F 161.

The nozzle clogging detection circuit 201 comprises a shape correction circuit 211, an amplifier circuit 221, a filter circuit 231, a peak hold part 241 as a sampling section, an A/D conversion circuit 251 or the like.

The CPU 111 reads out a system program, or various processing programs and data stored in the ROM 121, expanding them in the RAM 131, and performs a central control of operations of the whole ink jet printer 1 according to the programs expanded. That is, the CPU 101 performs a timing control of the whole system, storing and accumulation controls of data with the use of the RAM 131, an output of print data to each head module, an input-output control of an operating portion which is not shown, an interface (I/F) to other applications, or an operation control.

To realize the first embodiment, when the operation mode of the ink jet printer 1 is set to the nozzle clogging judging operation, the CPU 111 sets an ink jet drive condition which is different from that in the image recording operation, that is, the CPU 111 drives and controls the drive circuit 171 so that the maximum diameter r of ink droplets jetted from the nozzles in the nozzle clogging detection is larger than the size of normal ink droplets (maximum diameter) in the image recording on the recording medium P, and is not larger than the width W of the channels formed on the ink droplet landing surface S1 of the cover 611 (refer to FIG. 4B). Also, a maximum voltage value, a count number or an output cycle as a judgmental standard of the nozzle clogging judging operation is appropriately set to judge nozzle clogging. When the CPU 111 judges that nozzle clogging exists, the maintenance part 50 is controlled to drive to solve nozzle clogging.

When the maximum voltage value is used as the judgmental standard for nozzle clogging, a maximum voltage value $V_{max}$ of a sampling detected signal Sd' to be described later which is stored in the RAM 131 is calculated in each jetting operation, and each maximum voltage value $V_{max}$ is compared with the standard voltage value $V_0$ to judge nozzle clogging.

When the count number is used as the judgmental standard for nozzle clogging, nozzle clogging is judged by counting the number of the sampling detected signals Sd' not less than the predetermined standard voltage value $V_0$, and comparing the count number N which was counted with the number of ink droplet jetting operations n.

When the output cycle is used as the judgmental standard, a standard cycle T0 as an output cycle of an ink jet signal $S_{m1}$ is compared with each detected cycle T1 as an output cycle of the sampling detected signal Sd' to judge nozzle clogging.

The ROM 121 stores a program or a system program for driving the ink jet printer 1, various programs corresponding to the system, data necessary for processing with the various processing programs and the like.

To realize the first embodiment, the ROM 121 stores the standard voltage value $V_0$, which is the maximum voltage value of the sampling detected signal Sd' when ink droplets are properly jetted onto the ink droplet landing surface S1, the predetermined number of ink droplet jetting operations n, and a delay time td to be described later.

The RAM 131 is a temporally storing region for programs, input or output data, parameters read out from the ROM 121 in various processing controlled and executed by the CPU 111.

To realize the first embodiment, the RAM 131 temporally stores the sampling detected signal Sd' input from the A/D conversion circuit 251 through the I/F, the maximum voltage values $V_{max}$ calculated by the CPU 111, the count number N which was found by counting the number of the sampling detected signals Sd' not less than the predetermined standard voltage value $V_0$, and the standard cycle T0 of the ink jet signal $S_{m1}$ and the detected cycles T1 of the sampling detected signal Sd' which are clocked by a timer or the like, in chronological order.

The I/O 141 is for input and output of data between the control unit 101 and a control unit of each portion. To realize the first embodiment, the I/O 141 is connected to a shape correction control unit for controlling the shape of the piezo film 62 and a maintenance control unit for controlling the operations of the maintenance part 50, and also connected to control units such as an ink supply/waste fluid control unit, a waste ink control unit or the like.

The various machines control unit 151 is connected to a paper feed control unit for controlling various rollers and the paper pick up device 12 of the paper feed part 10, a carrying control unit for controlling various rollers of the carrying part 20, and a sensor control unit for driving various sensors provided in the ink jet printer 1 and the like, each of which operates based on the instructions from the CPU 111.

Ink droplets used for image recording are in the form of mist for improving resolution of an image, that is, the size thereof is extremely small, so that impact force generated when the ink droplets land is small, which is difficult to be detected with high accuracy. Therefore, there is a need to jet ink droplets with a size which allows the piezo film 62 to detect the impact force generated when the ink droplets land with high accuracy in the nozzle clogging detection. That is, the size of the ink droplets is needed to be larger than that in the image recording to intentionally increase the impact force generated by the landing of ink droplets.

To realize the first embodiment, the drive circuit 171 changes the ink jet signal $S_{m1}$ base on the ink jet drive condition from the CPU 111, driving the nozzles of each head module of each head unit 311, 321, 331, 341, generating an ink jet signal $S_{m1}$ for jetting ink droplets from the nozzles to have the maximum diameter r of ink droplets which is larger than the maximum diameter in the image recording and is not larger than the width w of the channels, and generates a sampling signal Ss which is delayed for 1 cycle of the ink jet signal $S_{m1}$ as a delay time $t_{d1}$ with a rise time of the jet drive signal $S_{m0}$ as a starting point to output it.

Changing the size of ink droplets in nozzle clogging detection can be set by changing positive voltage drive time/negative voltage drive time, or voltage value. Changing the size of ink droplets in nozzle clogging detection can also be realized by generating the ink jet signal $S_{m1}$ a plurality times within available hours of the jet drive signal $S_{m0}$.

Based on the set ink jet signal $S_{m1}$, ink droplets which allow impact force generated when the ink droplets land to be detected with high accuracy can be jetted.

The ink jet signal $S_{m1}$ calculated is output to the nozzles of each head module, and the sampling signal Ss is output to the peak hold part 241.

The delay time $t_{d1}$ is determined based on the drive waveform condition of the ink jet signal $S_{m1}$.

The drive waveform condition is determined based on the ink type to be jetted (for example, water-based ink, oil-based ink, ultraviolet curable ink, solid ink or the like), the jetting method (piezo system using piezoelectric elements, thermal system using a heater, or the like), a head configuration or the like.

The shape correction circuit 211 adjusts the output signal from the piezo film 62 based on the instructions from the shape correction control unit to make the piezo vibration signal Sd to be output constant within the range of the preset initial value in a case where the piezo film 62 is in the initial condition.

The piezo vibration signal Sd as a detection signal output from the piezo film 62 is amplified and adjusted by the amplifier circuit 221, and is subjected to filtering out noise with the filter circuit 231. The denoised piezo vibration signal Sd is input to the peak hold part 241.

The peak hold part 241 extracts the piezo vibration signal Sd input from the filter circuit 231 based on the sampling signal Ss input from the drive circuit 171. The extracted piezo vibration signal Sd is, as the sampling detected signal Sd', subjected to A/D conversion by the A/D conversion circuit 251 to be stored in the RAM 131 through the I/F 161.

Figure 9:
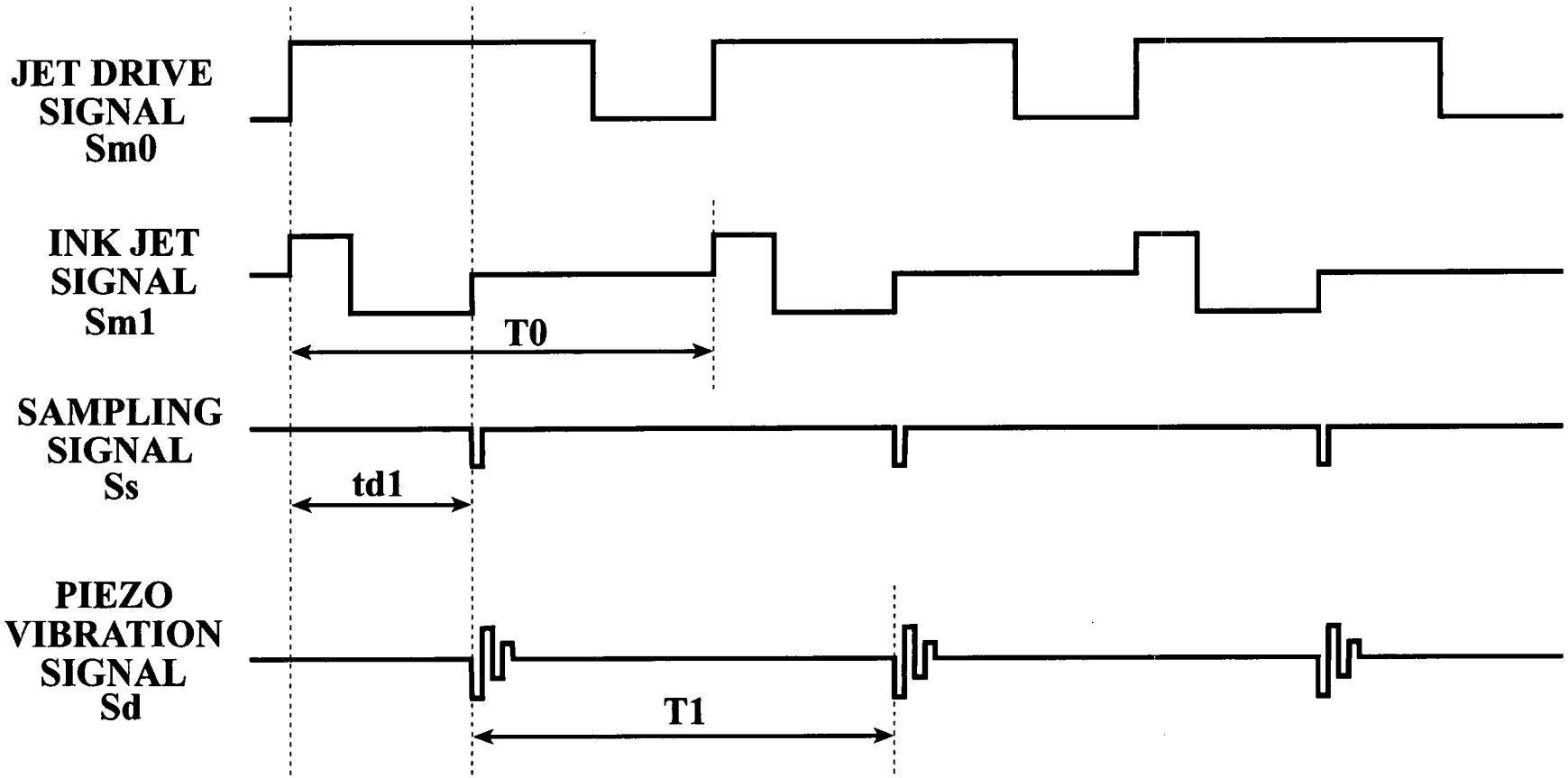
FIG. 9 is a time chart of an operation of jetting an ink droplet from a nozzle jet opening.

FIG. 9 shows an example of a time chart of the ink droplet jetting operation from the nozzle jet openings.

As shown in FIG. 9, there are shown the jet drive signal $S_{m0}$ as the instruction signal of the ink droplet jetting operation, which is output from the CPU 111 to the drive circuit 171, the ink jet signal $S_{m1}$ and the sampling signal Ss, which are output from the drive circuit 171 based on the jet drive signal $S_{m0}$ to the head of the head module 31*a* for judging nozzle clogging and the peak hold part 240, respectively, and the piezo vibration signal Sd output from the piezo film 62 based on the ink jet signal $S_{m1}$.

After the jet drive signal $S_{m0}$ is output, the ink jet signal $S_{m1}$ is output. When the delay time $t_{d1}$ passes after the output of the ink jet signal $S_{m1}$, the sampling signal Ss is output. Also, when the delay time $t_{d1}$ passes, ink droplets land onto the ink droplet landing surface S1, so that the piezo vibration signal Sd is output. The piezo vibration signal Sd is extracted based on the sampling signal Ss, and the nozzle clogging judging operation is performed.

When there is no nozzle clogging, the standard cycle T0 of the ink jet signal $S_{m1}$ equals to the detected cycle T1 of the piezo vibration signal Sd.

Next, description will be made for the nozzle clogging judging operation performed by the control unit 101.

Figure 10:
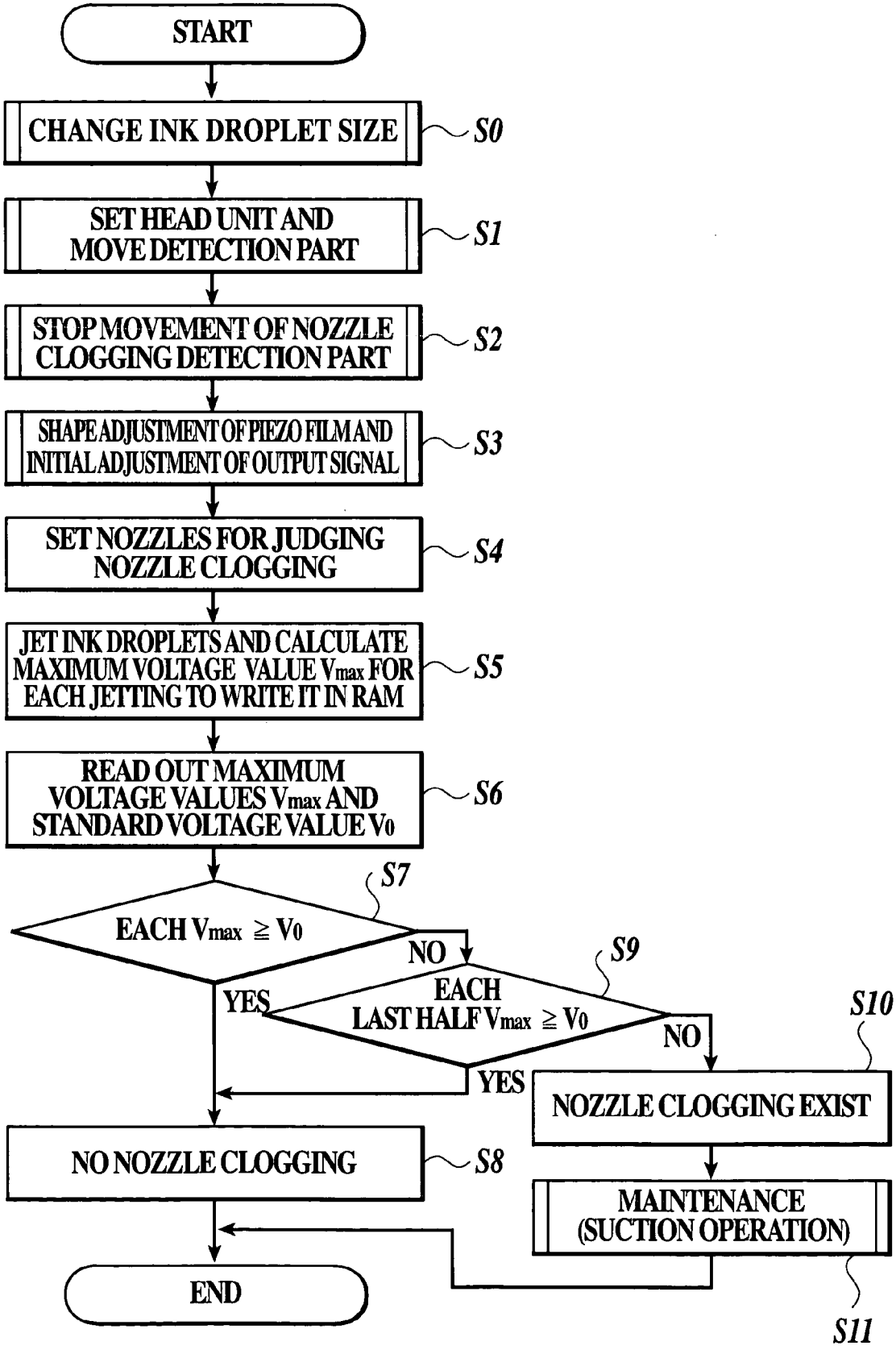
FIG. 10 is a flow chart of a nozzle clogging judging operation in a case where a judgmental standard in the first embodiment is a maximum voltage value.
Figure 11:
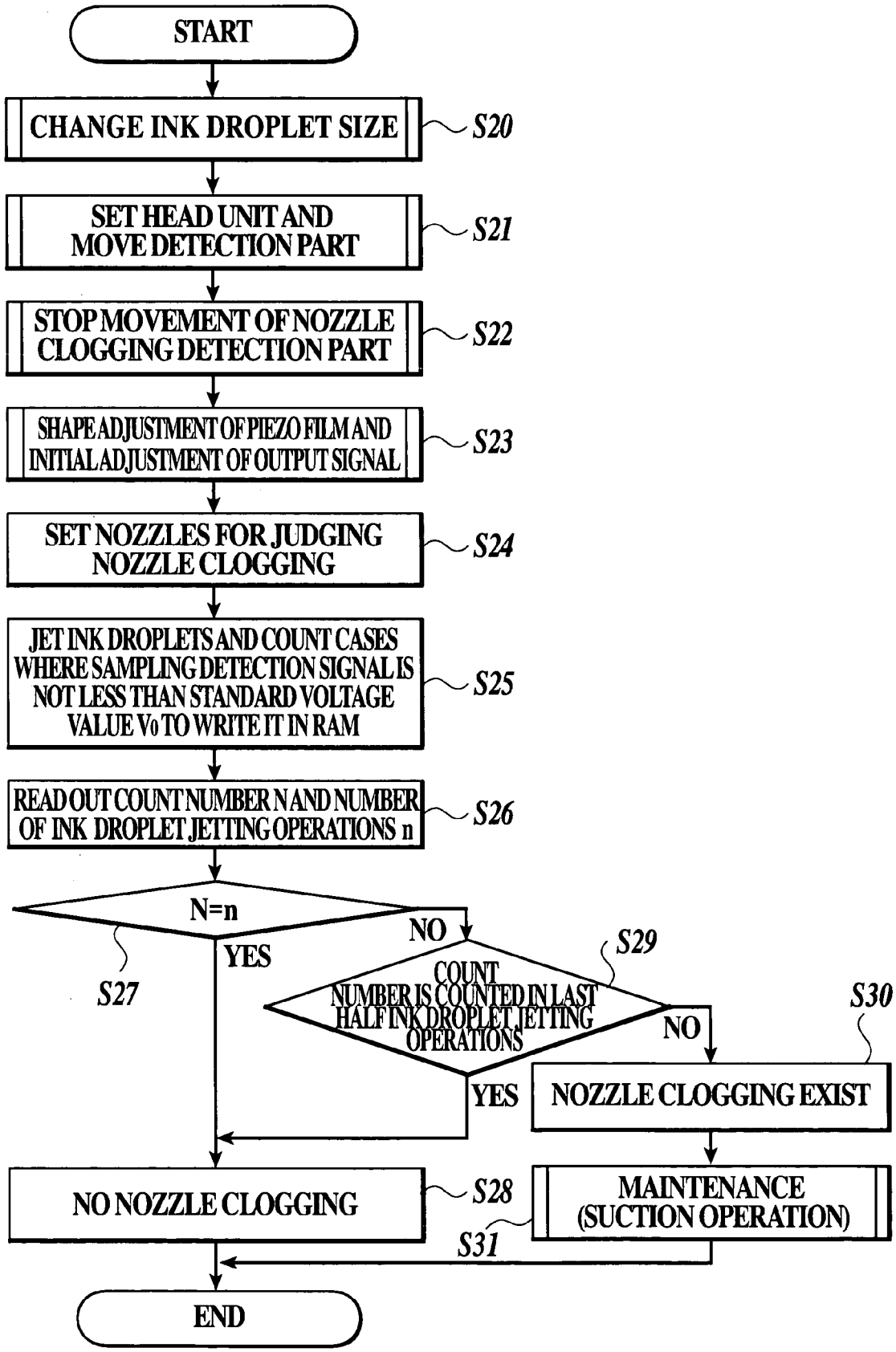
FIG. 11 is a flow chart of the nozzle clogging judging operation in a case where the judgmental standard in the first embodiment is a count number.
Figure 12:
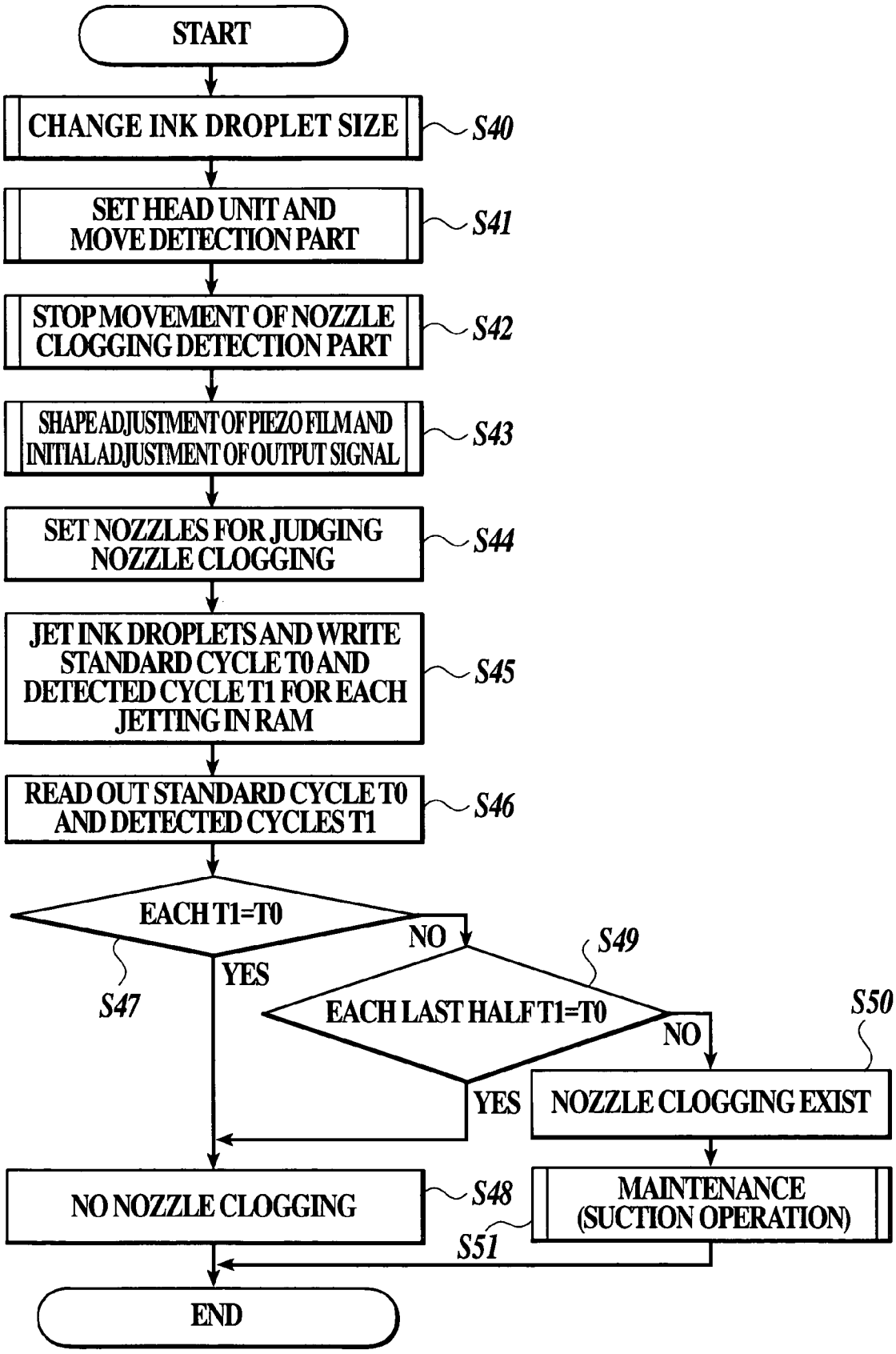
FIG. 12 is a flow chart of the nozzle clogging judging operation in a case where the judgmental standard in the first embodiment is an output cycle.

FIGS. 10 to 12 show flow charts of the nozzle clogging judging operation of the first embodiment.

FIG. 10 shows a flow chart in a case where the nozzle clogging judging operation is performed based on the maximum voltage value $V_{max}$ of the sampling detected signal Sd' as a judgmental standard.

When the operation mode of the ink jet printer 1 in the first embodiment is set for the nozzle clogging judging operation, the size of ink droplets to be jetted from the nozzles is changed (Step S0). The size of the ink droplets is changed as described above (maximum diameter r of ink droplet≦width of channel w).

The head unit which is subjected to the nozzle clogging judgment is set. Thereafter, the nozzle clogging detection part 601 is moved to a predetermined position below the set head unit (Step S1).

After the nozzle clogging detection part 601 was moved to the predetermined position, mechanical vibration of the nozzle clogging detection part 601 is stopped (Step S2).

After the nozzle clogging detection part stopped moving, the shape of the piezo film 62 is adjusted. Also, the output signal from the piezo film 62 is adjusted so that the piezo vibration signal Sd to be output from the piezo film 62 would be constant within the range of the preset initial value (Step S3).

After the initial setting of the output signal from the piezo film 62, nozzles for judging nozzle clogging are set (Step S4).

The ink jet signal $S_{m1}$ is output to the set nozzles, and then ink droplets are jetted. When the ink droplets jetted land on the ink droplet landing surface S1, the piezo vibration signal Sd is output from the piezo film 62, and the sampling detected signal Sd' is stored in the RAM 131 based on the sampling signal Ss. The maximum voltage value $V_{max}$ of the sampling detected signal Sd' is calculated in each ink droplet jetting operation to be stored in the RAM 131 (Step S5).

When the ink droplet jetting operation from the set nozzles is performed as many times as the number of ink droplet jetting operations n, all maximum voltage values $V_{max}$ of the ink droplet jetting operations stored in the RAM 131 in chronological order, and the standard voltage value V0 stored in the ROM 121 are read out to the CPU 111 (Step S6).

In the judgment step (S7) as the judgment section, a judgment is made whether each maximum voltage value $V_{max}$ of the ink droplet jetting operations which was read out is not less than the standard voltage value $V_0$.

When each maximum voltage value $V_{max}$ is not less than the standard voltage value $V_0$ (Step S7; Yes), the ink droplet jetting operations are judged to be normal, therefore, a judgment is made that there is no nozzle clogging (Step S8).

When not all the maximum voltage values $V_{max}$ are not less than the standard voltage value $V_0$ (Step S7; No), a judgment is made whether each maximum voltage value $V_{max}$ in the last half of the ink droplet jetting operations is not less than the standard voltage value $V_0$ (Step S9).

When each maximum voltage value $V_{max}$ in the last half of the ink droplet jetting operations is not less than the standard voltage value $V_0$ (Step S9; Yes), the ink droplet jetting operations are judged to be normal, and a judgment is made that there is no nozzle clogging (Step S8).

When not all the maximum voltage values $V_{max}$ in the last half of the ink droplet jetting operations are not less than the standard voltage value $V_0$ (Step S9; No), the ink droplet jetting operations are judged to be abnormal, and a judgment is made that nozzle clogging exists (Step S10).

When the judgment was made that nozzle clogging exists, the maintenance operation for solving the nozzle clogging (for example, suction operation or the like) is performed to the head module having the nozzle jet openings which need the maintenance (Step S11).

Ink droplets are jetted from the nozzle jet openings predetermined times, calculating the maximum voltage value $V_{max}$ of the sampling detected signal Sd' based on the landing of the ink droplets in each ink droplet jetting operation, and comparing each maximum voltage value $V_{max}$ with the standard voltage value $V_0$. When not all the maximum voltage values $V_{max}$ are not less than the standard voltage value $V_0$, a judgment is made that ink droplets are not jetted from the set nozzle jet openings (that is, nozzle clogging exists). Further, due to the structural feature of the ink jet head, there is a case that ink jetting is not performed for the initial stage of the ink droplet jetting operations, and is started after repeating ink droplet jetting operation for a few times, so that ink droplets are jetted in the middle or last half ink droplet detection operations to detect the maximum voltage values $V_{max}$. Even in such the case, a judgment can be made that there is no nozzle clogging, thereby enabling to properly performing the maintenance operation only in the case when the maintenance operation is needed.

The nozzle clogging judgment operation shown in FIG. 11 is the case where a judgment is made based on the count number N of the sampling detected signals Sd' as the judgmental standard. Steps S20 to S24 shown in FIG. 11 are same as Steps S0 to S4 shown in FIG. 10, therefore, the explanations thereof are omitted here.

The ink jet signal $S_{m1}$ is output to the set nozzles, and then ink droplets are jetted. When the ink droplets jetted land on the ink droplet landing surface S1, the piezo vibration signal Sd is output from the piezo film 62, and the sampling detected signal Sd' is stored in the RAM 131 based on the sampling signal Ss. The case where the sampling detected signal Sd' is not less than the standard voltage value $V_0$ is counted in the ink droplet jetting operations (Step S25).

When the ink droplet jetting operation from the set nozzles is performed as many times as the number of ink droplet jetting operations n, the count number N which was determined by counting a sampling detected signal Sd' which is not less than the standard voltage value $V_0$ in the sampling detected signals Sd' stored in the RAM 131 in chronological order, and the number of ink droplet jetting operations n which is set in the ROM 121 are read out to the CPU 111 (Step 526).

In the judgmental step (S27) as the judgmental section, a judgment is made whether the count number N is equal to the number of ink droplet jetting operations n.

When the count number N is equal to the number of ink droplet jetting operations n (Step S27; Yes), the ink droplet jetting operations are judged to be normal, and a judgment is made that there is no nozzle clogging (Step S28).

When the count number N is not equal to the number of ink droplet jetting operations n (Step S27; No), a judgment is made whether the count was made in the last half ink droplet jetting operations (Step S29).

When the count number N is counted in the last half operations (Step S29; Yes), the ink droplet jetting operations are judged to be normal, thereby, a judgment is made that there is no nozzle clogging (Step S28).

When the count number N is not counted in the last half operations (Step S29; No), the ink droplet jetting operations are judged to be abnormal, thereby, a judgment is made that nozzle clogging exists (Step S30).

When the judgment was made that nozzle clogging exists, the maintenance operation for solving the nozzle clogging (for example, suction operation or the like) is performed to the head module having the nozzle jet openings which need the maintenance (Step S31).

Ink droplets are jetted from the nozzle jet openings as many times as the number of ink droplet jetting operations n, and the case where the sampling detected signal Sd' based on the landing of the ink droplets in each jetting operation is not less than the standard voltage value $V_0$ is counted. The count number N counted is compared with the number of ink droplet jetting operations n. When the count number N is not equal to the number of ink droplet jetting operations n, a judgment can be made that ink droplets are not jetted from the set nozzle jet openings (that is, nozzle clogging exists). Further, due to the structural feature of the ink jet head, there is a case that ink jetting is not performed for the initial stage of the ink droplet jetting operations, and is started after repeating ink droplet jetting operation for a few times, so that ink droplets are jetted in the middle or in the last half ink droplet detection operations to be counted. Even in such the case, a judgment can be made that there is no nozzle clogging, thereby enabling to properly performing the maintenance operation only in the case when the maintenance operation is needed.

The nozzle clogging judgment operation shown in FIG. 12 is the case where a judgment is made based on the output cycle (detected cycle T1) of the sampling detected signal Sd' output as the judgmental standard. Steps S40 to S44 shown in FIG. 12 are same as Steps S0 to S4 shown in FIG. 10, therefore the explanations thereof are omitted here.

The ink jet signal $S_{m1}$ is output to the set nozzles, and then ink droplets are jetted. When the ink droplets jetted land on the ink droplet landing surface S1, the piezo vibration signal Sd is output from the piezo film 62, and the sampling detected signal Sd' is stored in the RAM 131 based on the sampling signal Ss. The standard cycle T0 of the ink jet signal $S_{m1}$ and the detected cycle T1 of the sampling detected signal Sd' in each ink droplet jetting operation are clocked to be stored in the RAM 131. The ink droplet jetting operation is performed as many times as the predetermined number of ink droplet jetting operations n (Step S45).

When the ink droplet jetting operation from the set nozzles is performed as many times as the predetermined number of ink droplet jetting operations n, the detected cycles T1 and the standard cycles T0 stored in chronological order in the RAM 131 are read out to the CPU 111 (Step S46).

In the judgmental step (S47) as a judgmental section, a judgment is made whether each detected cycle T1 of the ink droplet jetting operations which was read out is equal to the standard cycle T0.

When each detected cycle T1 is equal to the standard cycle T0 (Step S47; Yes), the ink droplet jetting operations are judged to be normal, therefore, a judgment is made that there is no nozzle clogging (Step S48).

When not all the detected cycles T1 are equal to the standard cycle T0 (Step S47; No), a judgment is made whether each detected cycle T1 in the last half ink droplet jetting operations is equal to the standard cycle T0 (Step S49).

When each detected cycle T1 in the last half ink droplet jetting operations is equal to the standard cycle T0 (Step S49; Yes), the ink droplet operations are judged to be normal, therefore, a judgment is made that there is no nozzle clogging (Step S48).

When not all the detected cycles T1 in the last half ink droplet jetting operations are equal to the standard cycle T0 (Step 49; No), the ink droplet jetting operations are judged to be abnormal, therefore, a judgment is made that nozzle clogging exists (Step 50).

When the judgment was made that nozzle clogging exists, a maintenance operation (for example, suction operation or the like) for solving the nozzle clogging is performed to the head module having the nozzle jet openings which need maintenance (Step S51).

Ink droplets are jetted from the nozzle jet openings as many times as the predetermined number of ink droplet jetting operations n, detecting the detected cycle T1 and the standard cycle T0 based on the landing of the ink droplets in each ink droplet jetting operation, and comparing each detected cycle T1 with the standard cycle T0. When not all the detected cycles T1 are not equal to the standard cycle T0, a judgment can be made that ink droplets are not jetted from the set nozzle jet openings (that is, nozzle clogging exists). Further, due to the structural feature of the ink jet head, there is a case where ink jetting is not performed for the initial stage of the ink droplet jetting operations, and is started after repeating ink droplet jetting operation for a few times, so that ink droplets are jetted in the middle or in the last half ink droplet detection operations to detect the detected cycles T1. Even in such the case, a judgment can be made that there is no nozzle clogging, thereby enabling to properly performing the maintenance operation only in the case when the maintenance is needed.

The nozzles for judging nozzle clogging may be set by the head module, the nozzle line, the nozzle, or the combination thereof.

In the first embodiment, the explanation was made to the case in which nozzle clogging is judged by appropriately setting each of the judgmental standards (maximum voltage value, count number, output cycle) shown in FIGS. 10, 11, 12 by the control unit 101, however, nozzle clogging may be judged by a combination of the judgmental standards.

The piezo film 62 mounted to face in the ink droplet jetting direction of the nozzles, and the ink droplet receiving part, which is interposed between the nozzles and the piezo film 62, for receiving ink droplets jetted from the nozzles and transmitting the impact force generated when ink droplets land to the piezo film 62 are provided. Further, the nozzle clogging detection part 601 for outputting the piezo vibration signal Sd based on electric charge from the piezo film 62, the peak hold part 241 for extracting the piezo vibration signal Sd based on the sampling signal Ss which is delayed from the ink jet signal $S_{m1}$, and the control unit 101 for judging nozzle clogging based on the sampling detection signal Sd' extracted from the peak hold part 241. Thereby, the landing of in droplets is detected by using the piezo film 62, enabling to detect nozzle clogging with easy structure, which results in decreasing the cost for the apparatus.

In the first embodiment, the screw is used as a position adjusting section for adjusting the maximum projecting portion of the curved outer periphery of the piezo film to the ink droplet landing position, however the supporting part 63 may be electrically moved by using a motor with high positioning accuracy such as a stepping motor or the like. In the case of electrically adjusting the position by using the motor or the like, the supporting part 63 is controlled to be positioned where there is no response from the piezo film in the state that ink droplets are not jetted, and be positioned where high cyclical response from the piezo film can be obtained in the state that ink droplets are jetted.

As described above, the explanation was made in the case where the piezo film is used as a vibration detection section, however, a strain gage may also be used.

Figure 13:
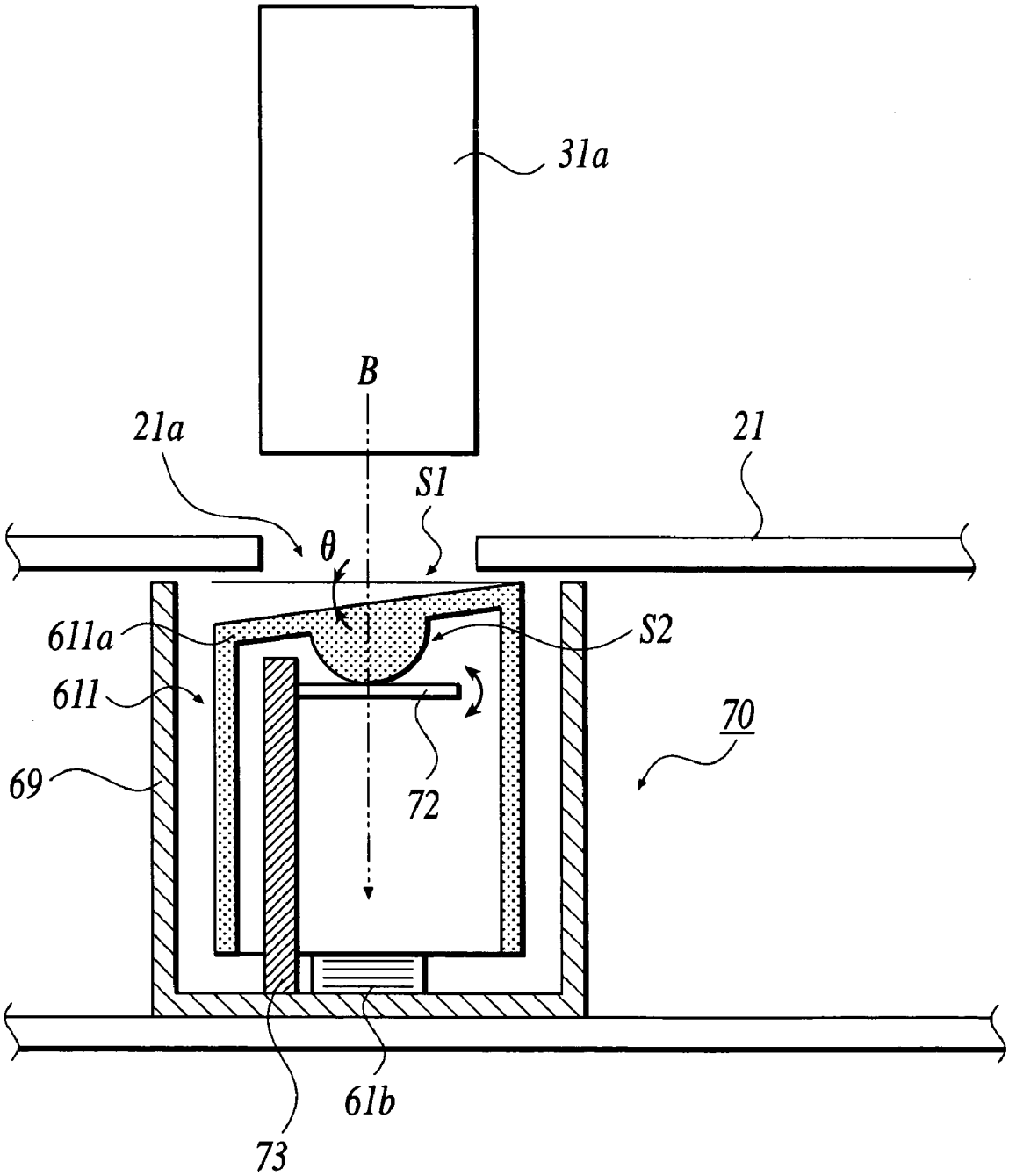
FIG. 13 is a schematic view of a nozzle clogging detection part 70 in which a strain gage is used.

FIG. 13 is a schematic view of a nozzle clogging detection part 70 in which a strain gage is used.

The nozzle clogging detection part 70 in which a strain gage is used comprises a vibration detection part 72 and a supporting part 73 instead of the piezo film 62 of the nozzle clogging detection part 601 in which a piezo film is used and the supporting part 63, and does not comprise the adjusting part 64. Other configurations are the same as that of the nozzle clogging detection part 601, therefore, the explanation thereof is omitted here.

The vibration detection part 72 is a member which is fixed to the supporting part 72 at one end, and comprises a strain gage which converts mechanical displacement (strain) of the vibration detection part 72 to electrical charge by contacting with the projecting portion of the contact surface S2 of the cover 611*a*.

That is, when ink droplets land on the ink droplet landing surface S1, the strain gage contacts with the projecting portion of the contact surface S2 of the cover 611*a* to transmit the impact force generated by the landing of the ink droplets. Thus, a signal based on the change of resistance of the strain gage is detected, so that it can be detected whether ink droplets land, and nozzle clogging can be judged.

[Second Embodiment]

The second embodiment will be explained referring to the drawings.

The configuration will be explained first.

Figure 14:
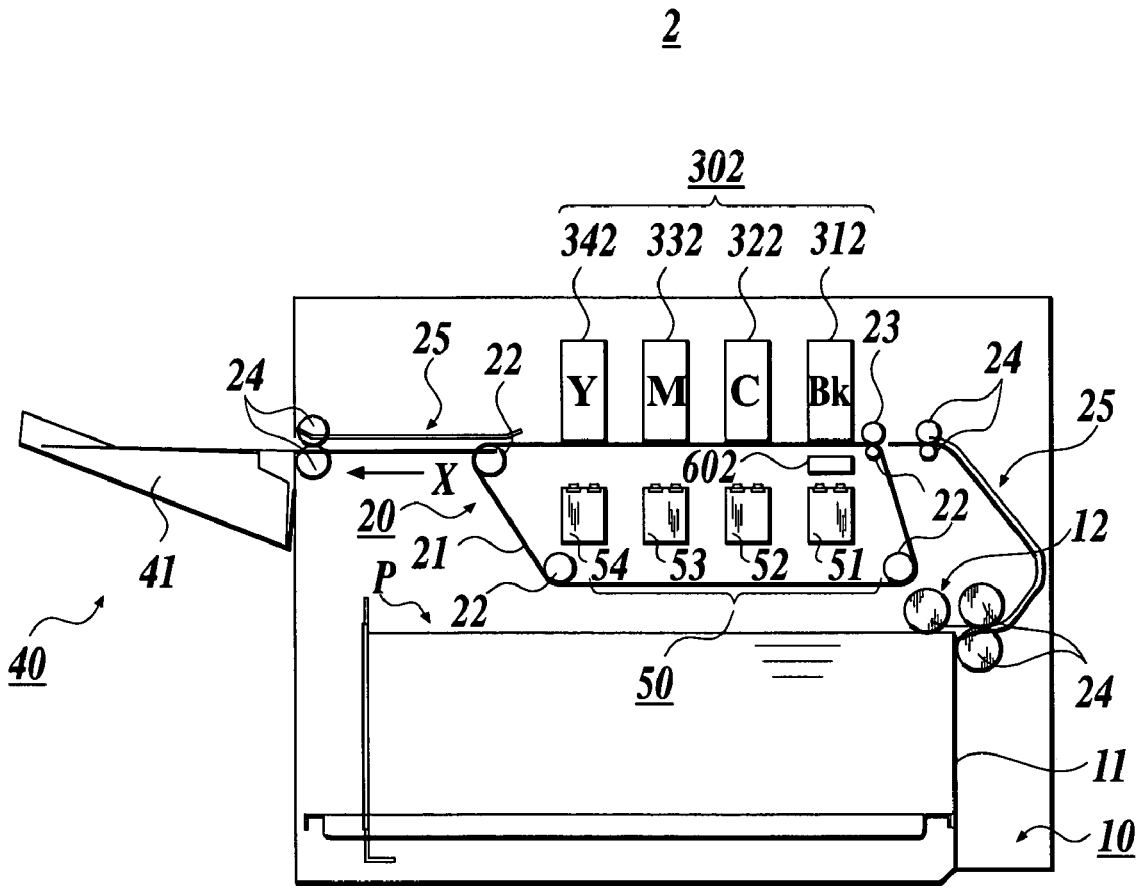
FIG. 14 is a schematic view of an inside of a line head type ink jet printer 2 in the second embodiment.

FIG. 14 shows a schematic view of the inside of an ink jet printer 2 of a long line head type in the second embodiment.

In the configuration of the ink jet printer 2 in the second embodiment, the component that is same as in the first embodiment will be given the same reference numeral and the explanations thereof will be omitted, thus only the different component will be explained. Specifically, the head unit part 301 and the nozzle clogging detection part 601 in the first embodiment correspond to a head unit part 302 and a nozzle clogging detection part 602 in the second embodiment, respectively.

The head unit part 302 comprises line head type head units 312, 322, 332, 342 at the portion near the upper portion of the carrying belt 21, for jetting each ink color of black (Bk), cyan (C), magenta (M) and yellow (Y) onto the recording medium P in this order along the carrying direction X, each of which comprises a plurality of nozzle jet openings (not shown) and extends along the whole width of the carrying belt 21. Each head unit 312, 322, 332, 342 is arranged such that the nozzle-plates face the periphery of the carrying belt 21.

The recording medium P on which an image is formed by jetting ink droplets from each head unit 312, 322, 332, 342 is discharged from the paper discharge part 40 in order.

Each head unit 312, 322, 332, 342 extends in a direction which is perpendicular to the carrying direction X of the recording medium P, and comprises a plurality of head modules as an ink jet section which is arranged in parallel with each other in the longitudinal direction thereof. Each head module extends in the longitudinal direction of each head unit 312, 322, 332, 342, and they are alternately arranged in parallel with each other at predetermined intervals in the carrying direction X of the recording medium P (staggered arrangement).

The nozzle clogging detection part 602 is provided at the lower portion of the head unit 302 to face thereto across the portion near the lower portion of the upper surface of the carrying belt 21, and is movable to the predetermined position corresponding to each head unit 312, 322, 332, 342. Also, they are alternately arranged in parallel with each other at predetermined intervals in the carrying direction X of the recording medium P to correspond to each head module.

Figure 15:
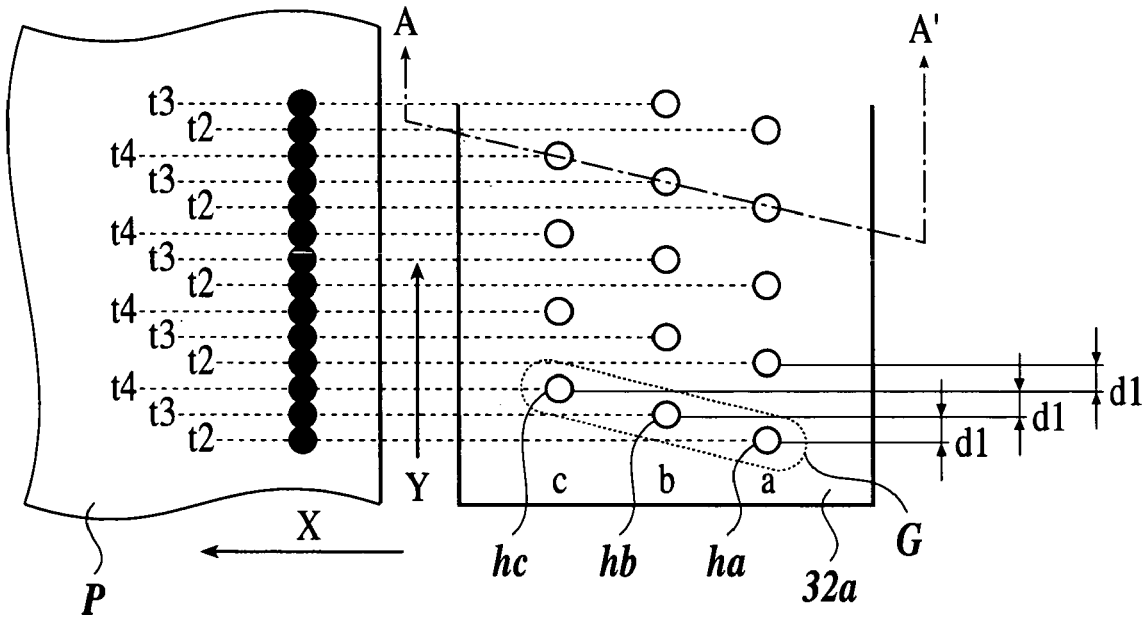
FIG. 15 is a partially expanded view of a head module 32*a* of a head unit 312 for black (Bk)

FIG. 15 shows a partially expanded view of the head module 32*a* of the head unit 312 for black (Bk).

As shown in FIG. 15, on the nozzle-plate which faces the recording medium P of the head module 32*a*, a plurality of nozzle groups G, each of which has a set of nozzles ha, hb, hc disposed at predetermined intervals along a direction diagonally crossing the carrying direction X, is arranged not to overlap with each other.

That is, the head module 32*a* comprises three nozzle lines a–c which are disposed in the main scanning direction Y of the recording medium P. Each of the nozzle jet openings ha, hb, hc of each nozzle line a–c are disposed to have an interval of about three times of the nozzle pitch d1 in the main scanning direction Y. The starting points of the nozzle lines a–c are disposed to misalign at a constant interval in the main scanning direction Y in the order of a, b, c, and the nozzle jet openings h of the lines are arranged not to overlap with one another with respect to the main scanning direction Y.

In the case of recording one line of an image in the main scanning direction Y on the recording medium P, nozzles of each line are driven at regular time intervals, that is, when the time is t2 to be described later, ink droplets are jetted from the nozzle jet openings of the line a, when the time is t3, ink droplets are jetted from the nozzle jet openings of the line b, and when the time is t4, ink droplets are jetted from the nozzle jet openings of the line c.

Figure 16A:
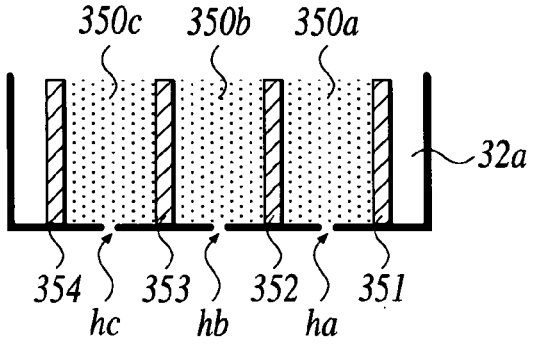
FIG. 16A is an end view showing a frame format of the head module 32*a* taken along the line A–A' at time t0 in the time chart shown in FIG. 17.

Ink droplets jetting operations from the nozzle jet openings h of the nozzle lines a–c in FIG. 15 will be explained referring to FIGS. 16A to 17.

FIGS. 16A to 16G are end views showing a frame format of the head module 32*a* in FIG. 15 taken along the line A–A'.

Figure 17:
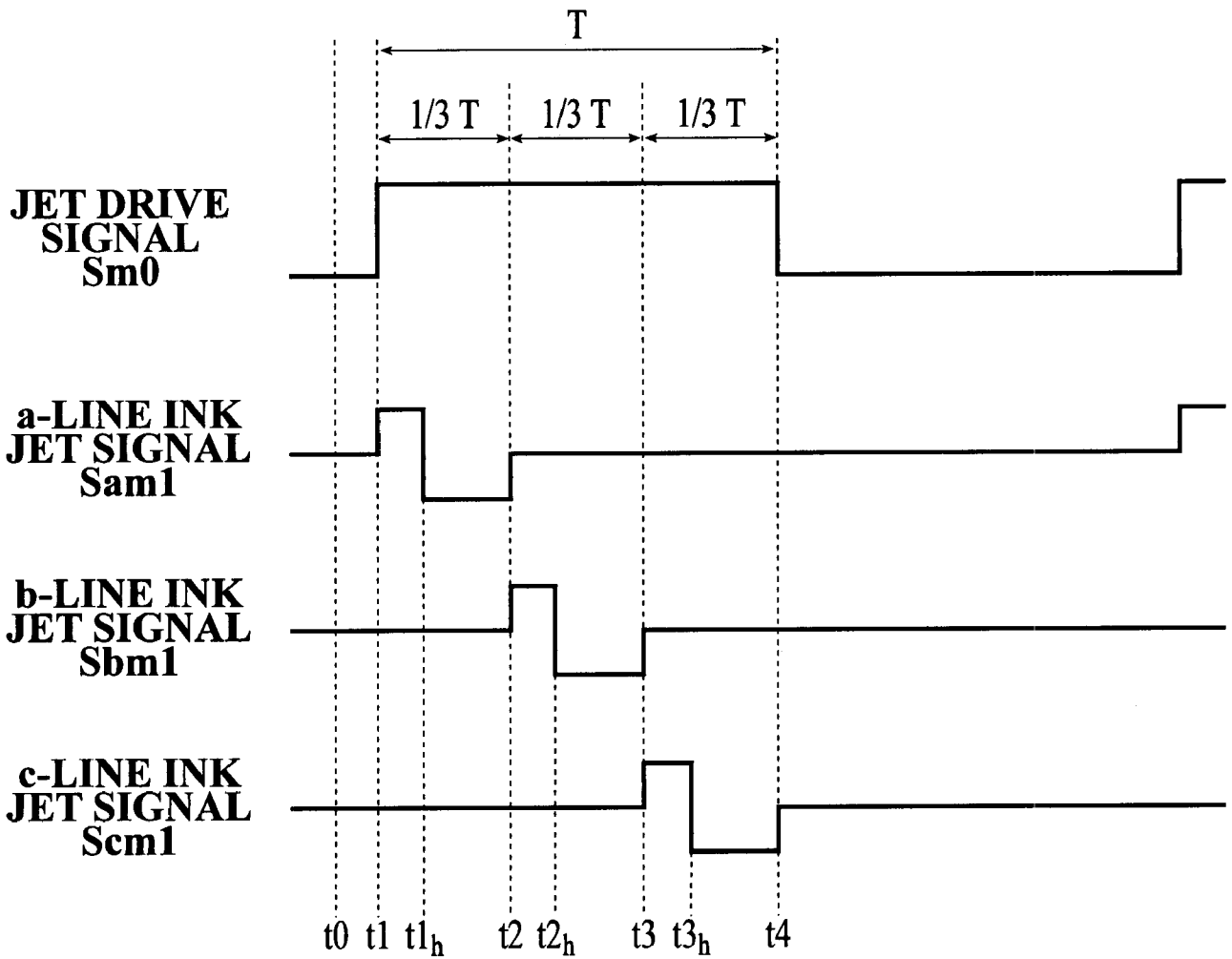
FIG. 17 is an example of a time chart of an ink droplet jetting operation from nozzle jet openings ha, hb, hc of nozzle lines a–c.

FIG. 17 is an example of a time chart of an ink droplet jetting operation from the nozzle jet openings ha, hb, hc of the nozzle lines a–c in FIG. 15.

As shown in FIGS. 16A to 16G, the head module 32*a* comprises first to fourth vibration plates 351, 352, 353, 354 formed with a piezoelectric element or the like, ink chambers 350*a*, 350*b*, 350*c* of the nozzle lines a–c in which ink for the nozzle lines a–c is filled between the vibration plates, nozzle jet openings ha, hb, hc of the nozzle lines a–c to jet ink droplets and the like. Hereinafter, the structure of each end view shown in FIGS. 16A to 16G is referred to as a "harmonica structure".

The head module having such harmonica structure is successful in shortening the nozzle pitch, thereby improving the resolution of an image to be recorded. However, due to the structural feature of the vibration plate, it is failure in adding the same pressure to the adjacent ink chambers at the same time, so that the nozzle lines a–c cannot be driven at the same time to jet ink droplets. Thus, the nozzle lines a–c are driven in order at regular intervals.

As shown in FIG. 17, as a method to jet ink droplets from the nozzle lines at regular time intervals, an a-line ink jet signal $Sa_{m1}$ for jetting ink droplets from the nozzle jet opening ha of the a-line, a b-line ink jet signal $Sb_{m1}$ for jetting ink droplets from the nozzle jet opening hb of the b-line and a c-line ink jet signal $Sc_{m1}$ for jetting ink droplets from the nozzle jet opening hc of the c-line are output in order at regular intervals based on a standard signal $S_{m0}$ (hereinafter, refer to as jet drive signal) for jetting ink droplets.

For example, each of the a-line ink jet signal $Sa_{m1}$, the b-line ink jet signal $Sb_{m1}$ and the c-line ink jet signal $Sc_{m1}$ is output in order after a lapse of ⅓ of the jet indication time T of the jet drive signal $S_{m0}$ (⅓T).

FIGS. 16A to 16G are end views of the head module at times t0, t1$_h$, t2, t2$_h$, t3, t3$_h$, t4 in the time chart shown in FIG. 17.

At time t1, when the jet drive signal $S_{m0}$ is output, the a-line ink jet signal $Sa_{m1}$ is output. The first and second vibration plates 351, 352 are curved in a direction to decrease the pressure inside the a-line ink chamber 350*a*.

Figure 16E:
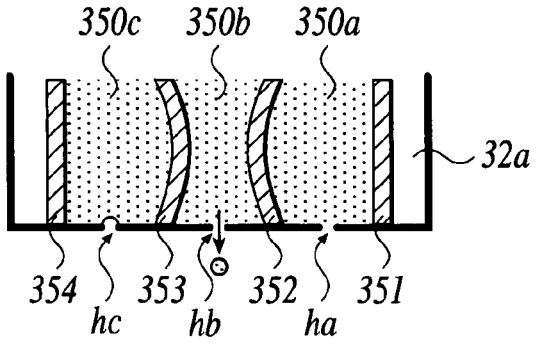
FIG. 16E is an end view showing a frame format of the head module 32*a* taken along the line A–A' at time t3 in the time chart shown in FIG. 17.
Figure 16B:
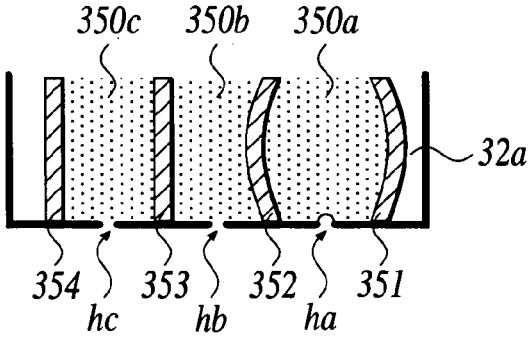
FIG. 16B is an end view showing a frame format of the head module 32*a* taken along the line A–A' at time $t1_h$ in the time chart shown in FIG. 17.

At time t1$_h$, the head module becomes as shown in FIG. 16B wherein the decrease of the pressure inside the a-line ink chamber 350*a* is maximum. After time t1$_h$, the voltage polarity of the a-line ink jet signal $Sa_{m1}$ is reversed, and the first and second vibration plates 351, 352 is actuated in the direction to increase the pressure inside the a-line ink chamber 350*a*.

At time t2, the b-line ink jet signal $Sb_{m1}$ is output. Each of the first and second vibration plates 351, 352 tries to return to the original position (FIG. 16A) from the position where the pressure inside the a-line ink chamber 350*a* is increased to the maximum (FIG. 16C). However, although the first vibration plate 351 returns to the original position by the b-line ink jet signal $Sb_{m1}$, the second vibration plate 352 is curved in the direction to decrease the pressure inside the b-line ink chamber 350*b* again together with the third vibration plate 353.

Figure 16F:
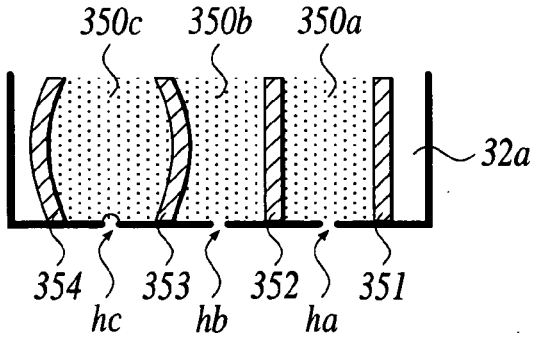
FIG. 16F is an end view showing a frame format of the head module 32*a* taken along the line A–A' at time $t3_h$ in the time chart shown in FIG. 17.
Figure 16C:
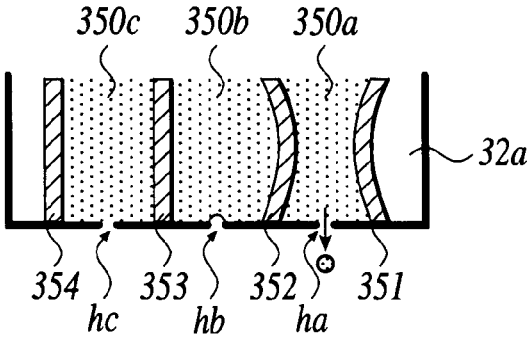
FIG. 16C is an end view showing a frame format of the head module 32*a* taken along the line A–A' at time t2 in the time chart shown in FIG. 17.
Figure 16G:
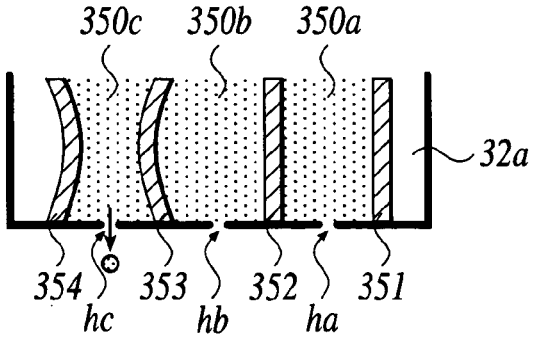
FIG. 16G is an end view showing a frame format of the head module 32*a* taken along the line A–A' at time t4 in the time chart shown in FIG. 17.
Figure 16D:
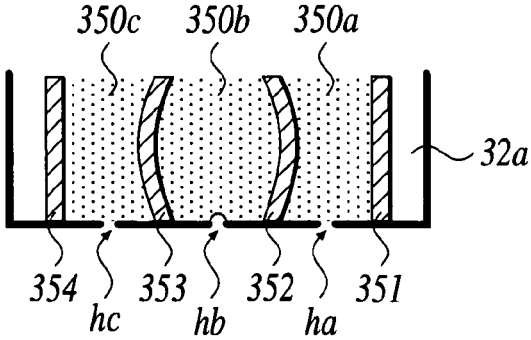
FIG. 16D is an end view showing a frame format of the head module 32*a* taken along the line A–A' at time $t2_h$ in the time chart shown in FIG. 17.

At time t2$_h$, the head module becomes as shown in FIG. 16D wherein the decrease of the pressure inside the b-line ink chamber 350*b* is maximum. After time t2$_h$, the voltage polarity of b-line ink jet signal $Sb_{m1}$ is reversed, and the second and third vibration plates 352, 353 are actuated in the direction to increase the pressure inside the b-line ink chamber 350*b*.

At time t3, the c-line ink jet signal $Sc_{m1}$ is output. The first vibration plate 351 remains stationary in the original position, and each of the second and third vibration plates 352, 353 tries to return to the original position (FIG. 16A) from the position where the pressure inside the b-line ink chamber 350*b* is increased to the maximum (FIG. 16E). However, although the second vibration plate 352 returns to the original position by the c-line ink jet signal $Sc_{m1}$, the third vibration plate 353 is curved in the direction to decrease the pressure inside the c-line ink chamber 350*c* again together with the fourth vibration plate 354.

At time t3$_h$, the head module becomes as shown in FIG. 16F wherein the decrease of the pressure inside the c-line ink chamber 350*c* is maximum. After time t3$_h$, the voltage polarity of c-line ink jet signal $Sc_{m1}$ is reversed, and each of the third and fourth vibration plates 353, 354 is actuated in the direction to increase the pressure inside the c-line ink chamber 350*c*.

At time t4, each of the first and second vibration plates 351, 352 returns to the original position and remain stationary. Each of the third and fourth vibration plates 353, 354 is actuated to return to the original position from the position where the pressure inside the c-line ink chamber 350*c* is increased to the maximum (FIG. 16G).

In any line, ink droplets are jetted from the ink chamber when the pressure inside the ink chamber becomes maximum (when facing vibration plates are curved toward the ink chamber the most).

Hereinafter, in the head module having the harmonica structure explained in FIGS. 15 to 17, the head in which each ink chamber is provided between facing vibration plates and which comprises nozzle holes for jetting ink droplets from each ink chamber in order at a timing of every ⅓ of the jet indication time T of the jet drive signal $S_{m0}$ is referred as "three cycle head".

Figure 18B:
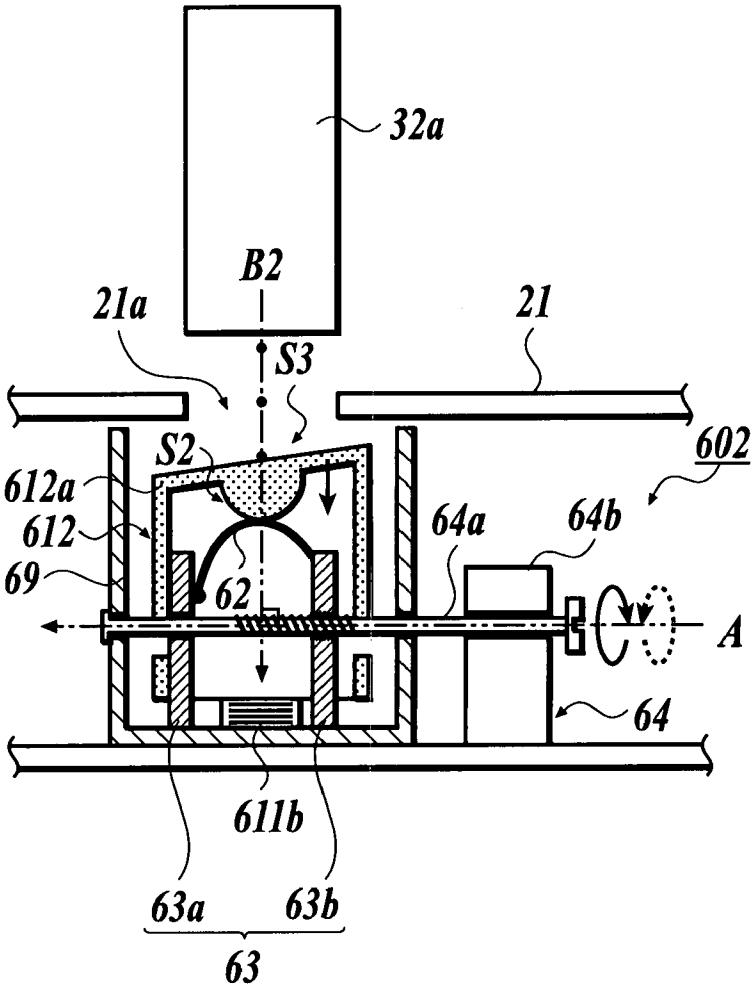
FIG. 18B is an end view of the nozzle clogging detection part 602 in an operating state in the second embodiment.
Figure 18A:
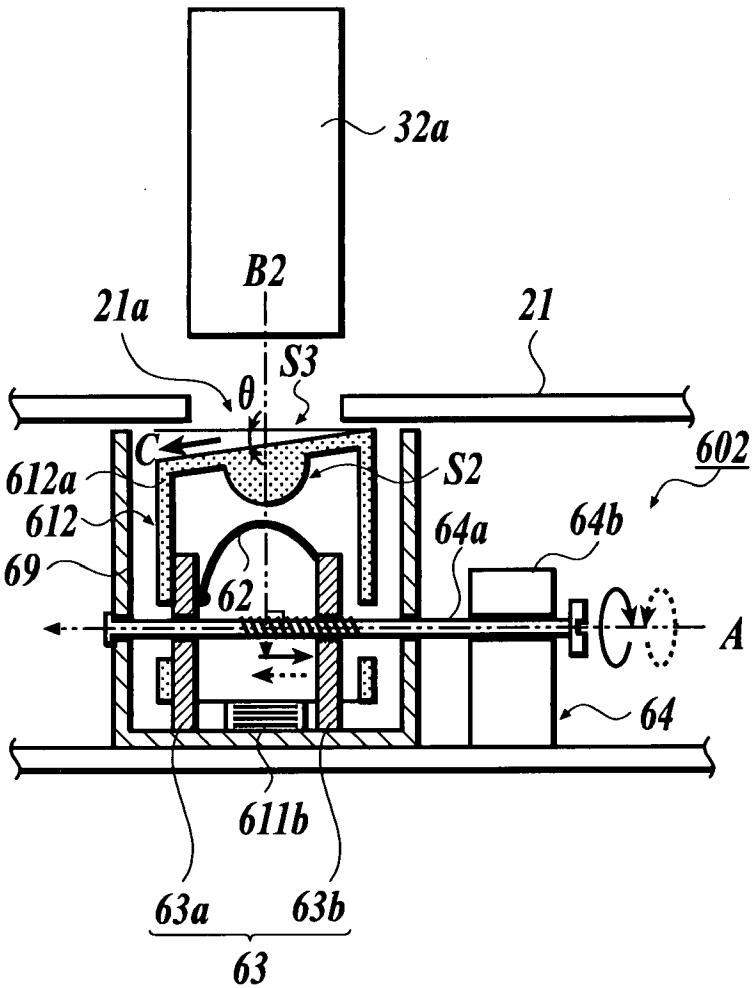
FIG. 18A is an end view of a nozzle clogging detection part 602 in an initial state in the second embodiment.

FIGS. 18A and 18B are end views of a nozzle clogging detection part 602.

FIG. 18A shows a state where the nozzle clogging detection part 602 has not received ink droplets from the head module 32*a* (initial state), and FIG. 18B shows a state where the nozzle clogging detection part 602 has received ink droplets from the head module 32*a* (operating state).

As shown in FIGS. 18A and 18B, in the configuration of the nozzle clogging detection part 602 in the second embodiment, the component that is same as in the first embodiment will be given the same reference numeral and the explanations thereof will be omitted, thus only the component with different function will be explained. Specifically, the cover 611*a* of the ink droplet receiving part 611, the ink droplet landing surface S1 for receiving ink droplets and the ink droplet jetting direction B1 correspond to a cover 612*a* of the ink droplet receiving part 612, an ink droplet landing surface S3 and an ink droplet jetting direction B2 from the nozzle line b, respectively.

Figure 19A:
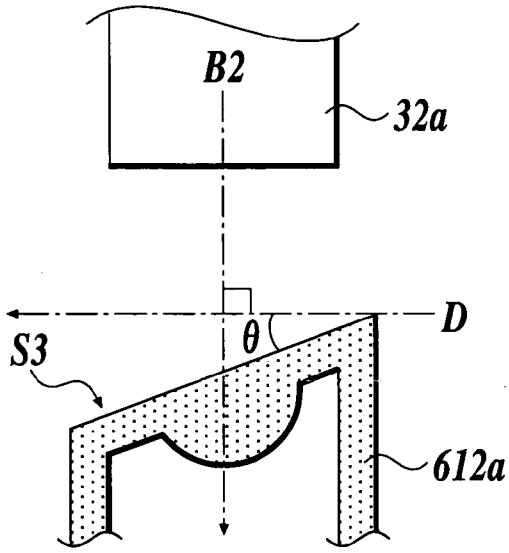
FIG. 19A is a schematic end view of an ink droplet landing surface S3 of a cover 612*a;*
Figure 19B:
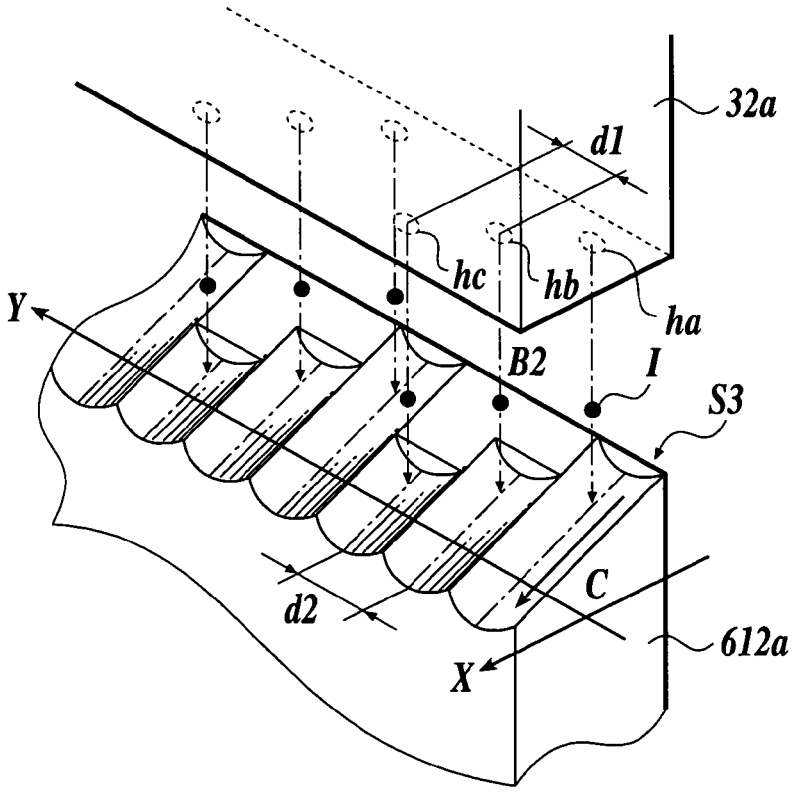
FIG. 19B is a perspective view of an example of a plurality of channels formed on the ink droplet landing surface S3 of the cover 612*a;*

FIGS. 19A and 19B show the ink droplet landing surface S3 of the ink the cover 612*a*.

FIG. 19A shows a schematic end view of the ink droplet landing surface S3 of the cover 612*a*, and FIG. 19B shows an example of a perspective view of a plurality of channels formed on the ink droplet landing surface S3.

As shown in FIG. 19A, the ink droplet landing surface S3 is inclined at the predetermined tilt angle θ in one direction with respect to a direction D which is perpendicular to the ink droplet jetting direction B2 of ink droplets jetted from the nozzles in the line b which is positioned in the middle of the head module 32*a* in the carrying direction X. The ink droplet jetting direction B2 is the same as the vertical direction.

As shown in FIG. 19B, on the ink droplet landing surface S3 for receiving ink droplets from the head module 32*a* of "three cycle head", a plurality of channels are formed to be parallel to one another. Each channel extends from the position where ink droplets from each nozzle jet opening lands to one end of the ink droplet landing surface S3.

For example, the channel corresponding to the nozzle jet opening ha which is positioned on the upper side in an inclination direction C is formed to be longer than the channel corresponding to the nozzle jet opening hc which is positioned on the lower side in the inclination direction C.

Each channel is opened on one end side in an longitudinal direction, and is inclined such that the opened portion at one end side in the longitudinal direction is positioned lower than the other end side in the vertical direction (that is, the ink droplet jetting direction B2). The arrangement pitch of the channels d2 (hereinafter, referred as channel pitch) is formed to be equal to that of the nozzles (hereinafter, referred as nozzle pitch) d1.

The cover 612*a* on which the channels are formed is provided such that a bottom portion of each channel corresponds to a position on which an ink droplet jetted from each nozzle jet opening h lands.

Providing such channels is successful in discharging ink droplets without positively removing the ink droplets landed onto the ink droplet landing surface S3 because the ink droplets run off along the inclination direction C of the channels every time ink droplets land. Therefore, the impact force generated by the landing of ink droplets can be detected with high accuracy, enabling to improve judgment accuracy of a jet failure of the nozzles.

Since the channel pitch d2 is equal to the nozzle pitch d1, each channel can be formed to correspond to each nozzle jet opening h. Thus, ink droplets can be efficiently discharged. Also, since the bottom portion of each channel corresponds to a position on which ink droplets land, it can be prevented that the ink droplets hit the upper end of the channels to disperse. Thus, the ink droplets can be efficiently discharged. Moreover, the impact force generated when ink droplets land can be efficiently received by the cover 612*a*.

The channels in the second embodiment are effective in the ink jet printer in which ink with relatively low viscosity in room temperature such as oil-based ink or water-based ink is used. Further, as a method for improving the effect, for example, in the ink jet printer in which water-based ink is used, the ink can be effectively removed by performing water repellent treatment to the surface of the cover 612*a* on which ink droplets land.

The shape of cross section of each channel in the second embodiment may be a curved shape other than an approximately semicircle shown in FIG. 19B, and the shape is not limited thereto as long as a shape is capable of efficiently discharging ink droplets and is easily formed.

In the second embodiment, the piezo film 62 is curved into an approximately half cylinder ahead in the ink droplet jetting direction B2 of ink droplets jetted from the nozzles in the b-line by the support part 63, and is supported to make the maximum projecting portion of the curved outer periphery direct to an ink droplet coming direction. The piezo film 62 extends corresponding to the longitudinal direction of the head module.

The cross sectional views showing examples of a contact state of the contact surface S2 of the cover 612*a* and the piezo film 62 in the second embodiment are approximately the same as those shown in FIGS. 5A and 5B in the first embodiment, therefore the explanations and the drawings are omitted here. The end views of another example of the nozzle clogging detection part 602 shown in FIGS. 18A and 18B are approximately the same as FIGS. 6 and 7 of the first embodiment, therefore, the explanations and the drawings are omitted here.

The control block diagram for controlling the ink jet printer 2 in the second embodiment is approximately the same as that in the first embodiment, therefore, the explanations and the drawings are omitted here.

It was described above that there are the a-line ink jet signal $Sa_{m1}$, the b-line ink jet signal $Sb_{m1}$ and the c-line ink jet signal $Sc_{m1}$ for driving the a–c nozzle lines, respectively. However, in order to simplify explanation, in the case of explaining an ink jet signal $S_{m1}$ to the nozzles which are set for judging nozzle clogging, time flow charts of an ink droplet jetting operation from a nozzle jet opening in the second embodiment is approximately the same as the flow chart in the first embodiment, therefore, the explanations and the drawings are omitted.

Flow charts of the nozzle clogging judging operations in cases where a judgmental standard in the second embodiment is a maximum voltage value, a count number, and an output cycle are approximately the same as the Step S1 to S11 in the flow chart of the nozzle clogging judging operation in the case where the judgmental standard is a maximum voltage value shown in FIG. 10, the Step S21 to S31 in the flow chart of the nozzle clogging judging operation in the case where the judgmental standard is a count number shown in FIG. 11, and the Step S41 to S51 in the flow chart of the nozzle clogging judging operation in the case where the judgmental standard is an output cycle shown in FIG. 12 in the first embodiment, respectively, therefore, the explanations and the drawings are omitted.

In the second embodiment, the explanation was made for the ink jet printer 2 comprising the head module of "three cycle head", however, it is not limited thereto so long as an ink jet printer comprises a plurality of head modules each of which has a plurality of nozzle groups which is arranged without overlapping with one another along the main scanning direction. Each of the plurality of nozzle groups has a set of nozzles disposed at predetermined intervals along a direction to diagonally cross the carrying direction X.

[Third Embodiment]

The third embodiment of the present invention will be explained below referring to the drawings.

The configuration will be explained first.

Figure 20:
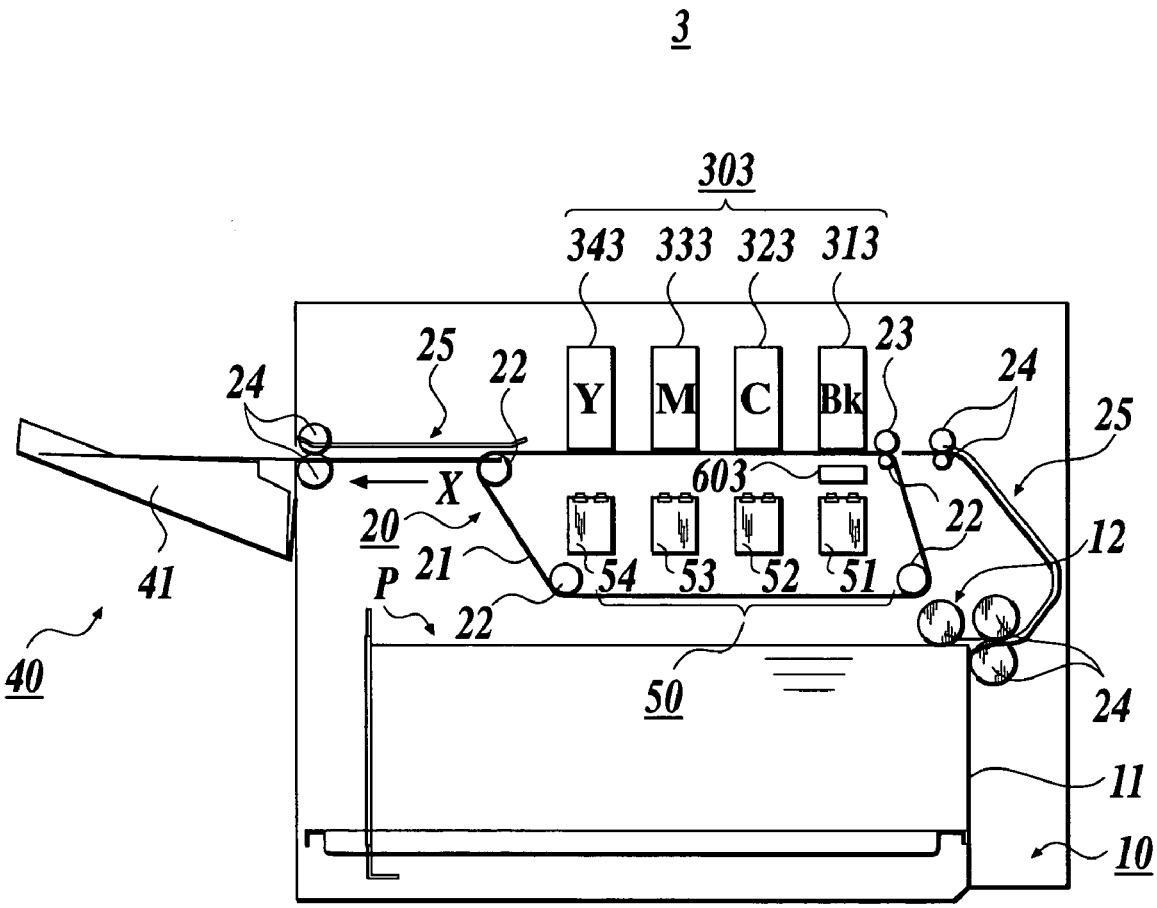
FIG. 20 is a schematic view of an inside of a line head type ink jet printer 3 in the third embodiment.

FIG. 20 shows a schematic view of the inside of an ink jet printer 3 of a line head type in the third embodiment.

In the configuration of the ink jet printer 3 in the third embodiment, the component that is same as in the first embodiment will be given the same reference numeral and the explanations thereof will be omitted, thus only the different component will be explained. Specifically, the head unit part 301 and the nozzle clogging detection part 601 in the first embodiment correspond to a head unit part 303 and a nozzle clogging detection part 603 in the third embodiment, respectively.

The head unit part 303 comprises line head type head units 313, 323, 333, 343 at the portion near the upper portion of the carrying belt 21, for jetting each ink color of black (Bk), cyan (C), magenta (M) and yellow (Y) onto the recording medium P in this order along the carrying direction X, each of which comprises a plurality of nozzle jet openings (not shown) and extends along the whole width of the carrying belt 21. Each head unit 313, 323, 333, 343 is arranged such that the long nozzle-plates face the periphery of the carrying belt 21.

The recording medium P on which an image is formed by jetting ink droplets from each head unit 313, 323, 333, 343 is discharged from the paper discharge part 40 in order.

Each head unit 313, 323, 333, 343 extends in a direction which is approximately perpendicular to the carrying direction X of the recording medium P, and comprises a plurality of head modules which is arranged in parallel in the longitudinal direction thereof. Each head module extends in the longitudinal direction of each head unit 313, 323, 333, 343, and they are alternately arranged in parallel with each other at predetermined intervals in the carrying direction X of the recording medium P (staggered arrangement).

The head module in the third embodiment is not limited to a head module in which a plurality of nozzles is disposed in an inline arrangement, a head module of "three cycle head" or the like.

The nozzle clogging detection part 603 is provided at the lower portion of the head unit 303 to face thereto across the portion near the lower portion of the upper surface of the carrying belt 21, and is movable to the predetermined position corresponding to each head unit 313, 323, 333, 343. Also, they extend in the longitudinal direction of the head unit and are alternately arranged in parallel with each other at predetermined intervals in the carrying direction X of the recording medium P to correspond to each head module.

Figure 21B:
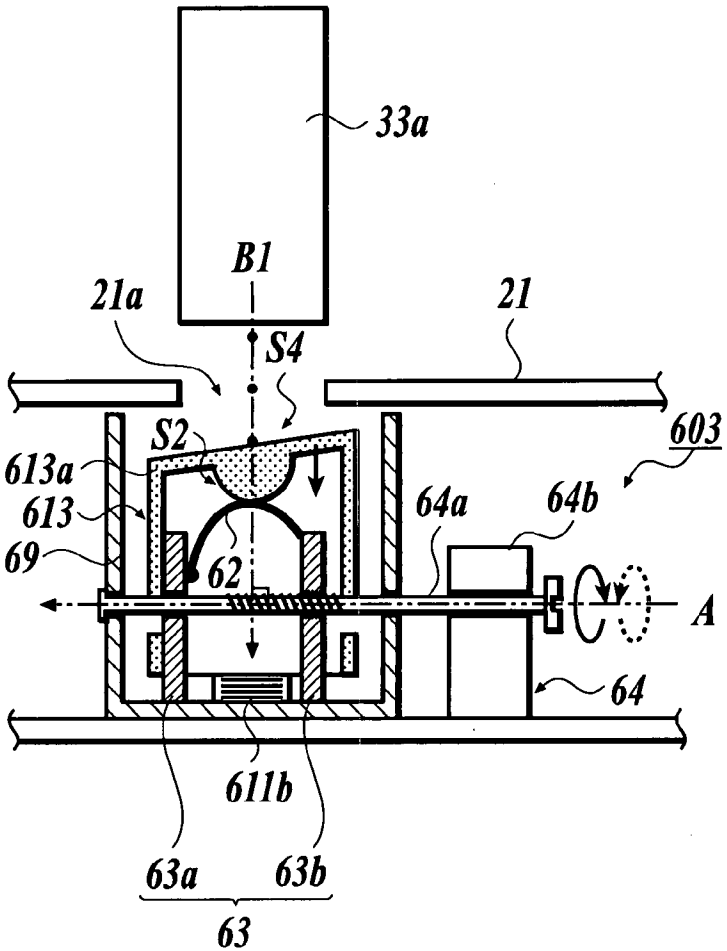
FIG. 21B is an end view of the nozzle clogging detection part 603 in an operating state in the third embodiment.
Figure 21A:
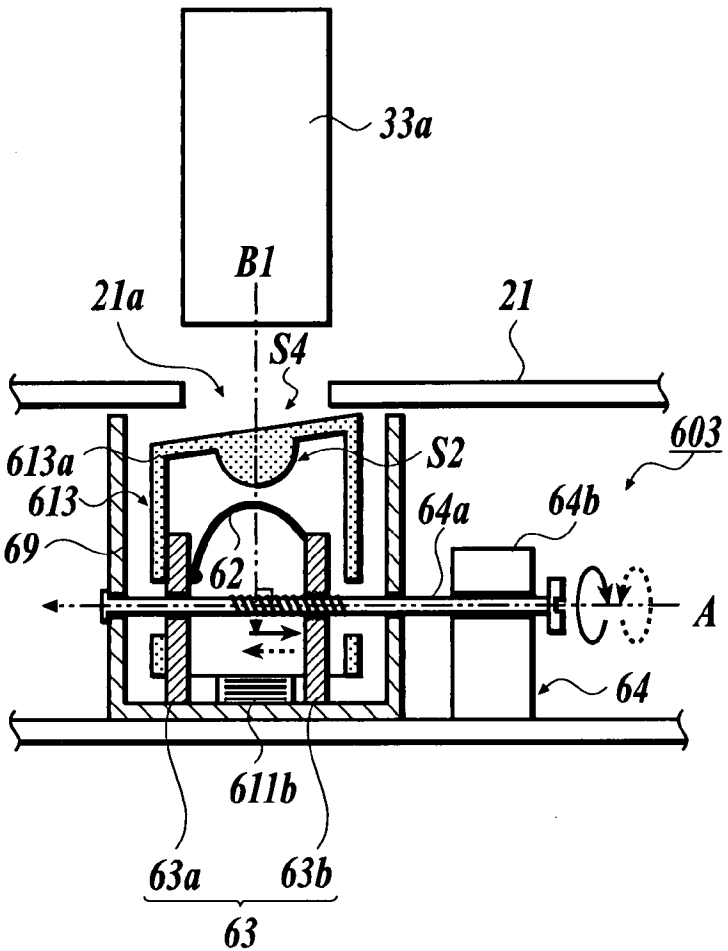
FIG. 21A is an end view of a nozzle clogging detection part 603 in an initial state in the third embodiment.

FIGS. 21A and 21B are end views of a nozzle clogging detection part 603.

FIG. 21A shows a state where the nozzle clogging detection part 603 has not received ink droplets from the head module 33*a* (initial state), and FIG. 21B shows a state where the nozzle clogging detection part 603 has received ink droplets from the head module 33*a* (operating state).

As shown in FIGS. 21A and 21B, in the configuration of the nozzle clogging detection part 603 in the third embodiment, the component that is same as in the first embodiment will be given the same reference numeral and the explanations thereof will be omitted, thus only the component with different function will be explained. Specifically, the cover 611*a* of the ink droplet receiving part 611 and the ink droplet landing surface S1 for receiving ink droplets correspond to a cover 613*a* of the ink droplet receiving part 613 and an ink droplet landing surface S4, respectively.

In the third embodiment, the explanation will be made in the case where a piezo film of a film shaped piezoelectric element is used as the vibration detection section, however, it is not limited thereto as long as the vibration detection section is capable of receiving ink droplets jetted from the nozzles and outputting mechanical displacement (vibration) as electric charge (amplitude) when the ink droplets land, thus, it may be a strain gage or the like.

The cover 613*a* comprises the ink droplet landing surface S4 for receiving ink droplets and the contact surface S2 for transmitting the impact force generated by contacting with the piezo film 62 when ink droplets land on the ink droplet landing surface S4. The contact surface S2 is provided with a projecting portion at a position to face the maximum projecting portion of the curved outer periphery of the piezo film 62 for transmitting the impact force generated when ink droplets land to the maximum projecting portion.

The cover 613*a* extends in the longitudinal direction of the head module corresponding thereto to be interposed between the nozzles and the piezo film 62, so that the piezo film 62 can be protected from various ink droplets. Thus, the response property of the piezo film 62 can be protected.

There is a case where an ink jet printer in which a property (viscosity) of the ink to be jetted is changed depending upon the ink is used. Specifically, there is a case where ink is heated to the temperature higher than room temperature, and ink droplets with high temperature are detected. In such ink jetting method, the temperature of the piezo film rises after receiving tens of ink droplets, which would cause a change to the response property of the piezo film. Thus, the cover 613*a* has a purpose to prevent such change of the response property. When the ink to be used is electrically conductive ink, the cover 613*a* can prevent the piezo film from being damaged when the electrically conductive ink contacts the output signal terminals of the piezo film.

The cover 613*a* is kept in resting state by the elastic supporting member 611*b* provided on the bottom portion, and transmits small impact force generated when the ink droplets land to the piezo film 62, so that it is preferable to use workpiece materials which are light in weight such as plastic or the like and can be formed to be an arbitrary shape.

In the ink jet printer 3 in the third embodiment, the cross sectional view showing an example of a contact state of the contact surface S2 of the cover 613*a* and the piezo film 62 in the third embodiment is approximately the same as those in the first embodiment, therefore the explanations and the drawings are omitted here.

Figure 22:
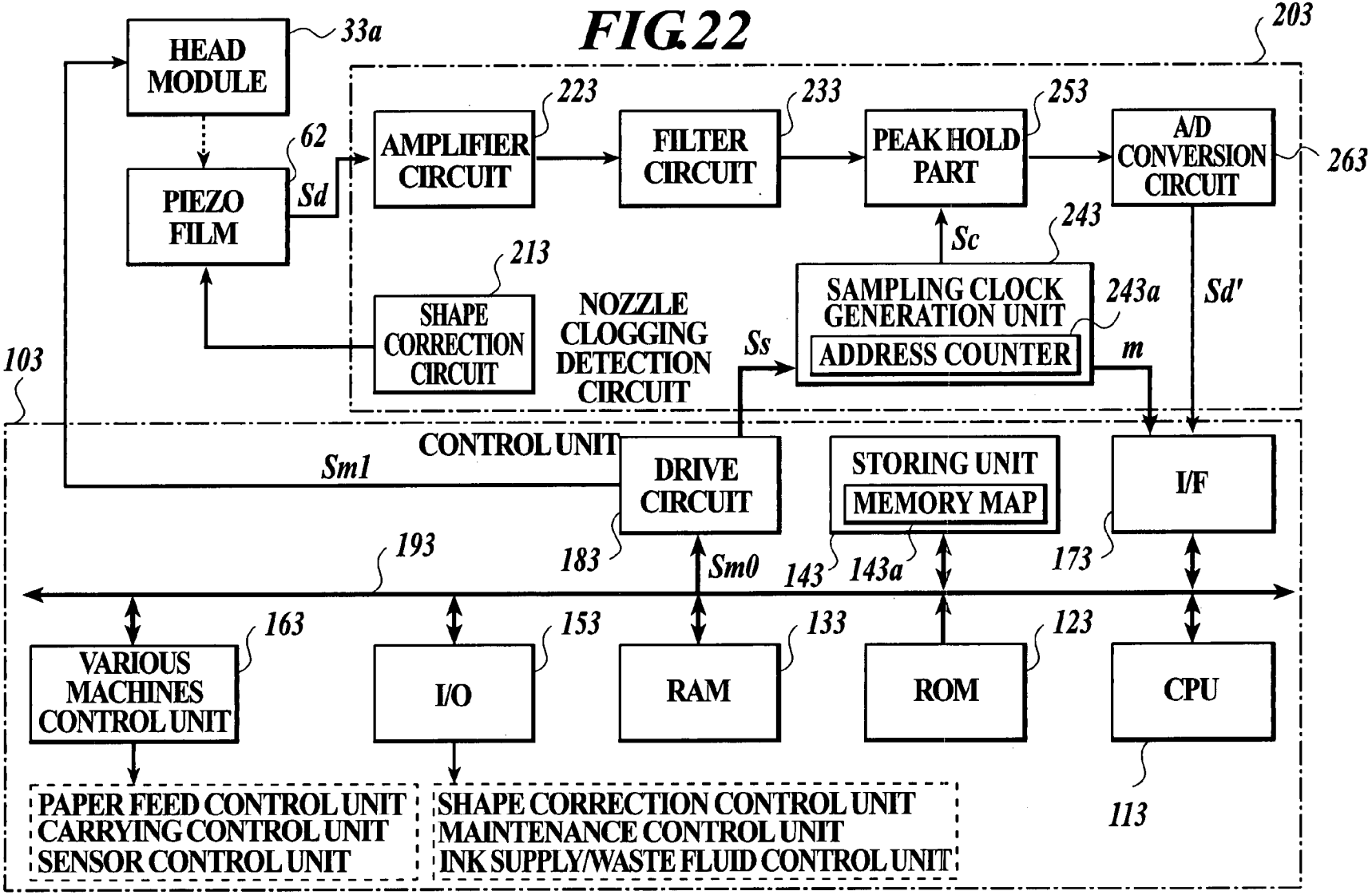
FIG. 22 is a control block diagram for controlling the ink jet printer 3 in the third embodiment.

FIG. 22 shows a control block diagram for controlling the ink jet printer 3 of the third embodiment. As shown in FIG. 22, the control system comprises a control unit 103 and a nozzle clogging detection circuit 203.

In the control unit 103, a CPU 113 as a judging section, a ROM 123, a RAM 133, a storing unit 143 as a storing section, an I/O 153, a various machines control unit 163, an I/F 173, a drive circuit 183 and the like are connected to a system bus 193, and the control unit 103 is connected to the nozzle clogging detection circuit 203 through the I/F 173.

The nozzle clogging detection circuit 203 comprises a shape correction circuit 213, an amplifier circuit 223, a filter circuit 233, a sampling clock generation unit 243 as a sampling section, a peak hold part 253, an A/D conversion circuit 263 or the like.

The CPU 113 reads out a system program, or various processing programs and data stored in the ROM 123, expanding them in the RAM 133, and performs a central control of operations of the whole ink jet printer 3 according to the programs expanded. That is, the CPU 113 performs a timing control of the whole system, storing and accumulation controls of data with the use of the RAM 133, an output of print data to each head module, an input-output control of an operating portion which is not shown, an interface (I/F) to other applications, or an operation control.

To realize the third embodiment, an address of a detected data Sd' as an amplitude value data showing a maximum voltage value $V_{max}$ as a maximum amplitude value is output from a memory map 143*a* to be described later which is stored in the storing unit 143 in each ink droplet jetting operation, and the nozzle clogging judging operation is performed based on the address number (number of addresses) which was read out. Further, the nozzle clogging judging operation is performed by comparing the maximum voltage value $V_{max}$ which is shown by the detected data Sd' corresponding to the address which was read out and the standard voltage value $V_0$ as a standard value.

When the judgment was made that nozzle clogging exists, the maintenance part 50 is driven to solve nozzle clogging.

The ROM 123 stores a program or a system program for driving the ink jet printer 3, various processing programs corresponding to the system, data necessary for processing with the various processing programs.

To realize the third embodiment, the ROM 123 stores the standard voltage value $V_0$, which is the maximum voltage value based on the detected data Sd' when ink droplets are properly jetted onto the ink droplet landing surface S4, a delay time $t_{d2}$ to be described later, and a sampling time period Ts.

The RAM 133 is a temporally storing region for programs, input or output data, parameters read out from the ROM 123 in various processing controlled and executed by the CPU 113.

The RAM 133 also temporally stores addresses read out from the storing unit 143, a sampling number m (number of samplings) calculated by a sampling clock generation unit 243 to be described later and the number of ink droplet jetting operations n which is set by an operating portion or the like which is not shown, and comprises an ink jet counter for counting the number of ink droplet jetting operations (jet count number N).

To realize the third embodiment, the storing unit 143 stores the sampling detected signal Sd' input from the A/D conversion circuit 251 through the I/F in the memory map 143*a* to correspond to each address.

FIG. 23 shows an example of the memory map 143*a* stored in the storing unit 143.

As shown in FIG. 23, each address in the memory map 143*a* consists of an upper address A1 and a lower address A2. The upper address A1 shows the number of ink droplet jetting operations n which was set, and the lower address A2 shows the sampling number m in each ink droplet jetting operation, that is, a clock number (number of clocks) of sampling clock signal.

For example, the detected data Sd' stored in the address "01x0001" is the voltage value (amplitude value) of the piezo vibration signal Sd as a detected signal presented in twos complement form when the clock number of the sampling clock signal is 1 in the first ink droplet jetting operation.

The storing unit 143 may be composed by using a part of the storing region of the RAM 133.

The I/O 153 is for input and output of data between the control unit 103 and a control unit of each portion. To realize the third embodiment, the I/O 153 is connected to a shape correction control unit for controlling the shape of the piezo film 62 and a maintenance control unit for controlling the operations of the maintenance part 50, and also connected to control units such as an ink supply/waste fluid control unit, a waste ink control unit or the like.

The various machines control unit 163 is connected to a paper feed control unit for controlling various rollers and the paper pick up device 12 of the paper feed part 10, a carrying control unit for controlling various rollers of the carrying part 20, and a sensor control unit for driving various sensors provided in the ink jet printer 3 and the like, each of which operates based on the instructions from the CPU 113.

The drive circuit 183 generates and outputs the ink jet signal $S_{m1}$ for jetting ink droplets from the nozzle jet openings by driving the nozzles of each head module of each head unit 313, 323, 333, 343, based on the print data and a jet drive signal $S_{m0}$ from the CPU 113. Also, the drive circuit 183 generates and outputs a sampling start signal Ss which is output after a lapse of a delay time $t_{d2}$ from a rise time as a generation time of the jet drive signal $S_{m0}$. The generated ink jet signal $S_{m1}$ is output to the nozzles of each head module and the sampling start signal Ss is output to the sampling clock generation unit 243.

The delay time $t_{d2}$ is determined as the time corresponding to the time needed for ink droplets to land based on the drive waveform condition of the ink jet signal $S_{m1}$. The drive waveform condition is determined based on the ink type to be jetted (for example, water-based ink, oil-based ink, ultraviolet curable ink, solid ink or the like), the jetting method (piezo system using piezoelectric elements, thermal system using a heater, or the like), a head configuration or the like.

For example, in a case of a head of piezo system, an ink droplet jetting operation is performed by the ink jet signal $S_{m1}$ comprising two drive waveforms. In this case, a positive voltage waveform is called "ON waveform", and a negative voltage waveform is called "OFF waveform". A time period $T_{on}$ of the "ON waveform" is a standard waveform for ink droplet jetting operations.

The delay time $t_{d2}$ is set to be twice of the "ON waveform" time period $T_{on}$ of the ink jet signal $S_{m1}$.

The sampling start signal Ss is a signal for instructing detection of the piezo vibration signal Sd, and a time period Ts (hereinafter, referred as sampling time period) for detecting the piezo vibration signal Sd shows a "LOW" state.

For example, in a case of a head of piezo system, the sampling time period Ts is set to be twice of the "ON waveform" time period $T_{on}$ with the rise time of the "OFF waveform" of the ink jet signal $S_{m1}$ as a center.

The shape correction circuit 213 adjusts the output signal from the piezo film 62 based on the instructions from the shape correction control unit to make the piezo vibration signal Sd to be output constant within the range of the preset initial value in a case where the piezo film 62 is in the initial condition.

The piezo vibration signal Sd as a detection signal output from the piezo film 62 is amplified and adjusted by the amplifier circuit 223, and is subjected to filtering out noise with the filter circuit 233. The denoised piezo vibration signal Sd is input to the peak hold part 253.

The sampling clock generation unit 243 receives the sampling start signal Ss and the sampling time period Ts input from the drive circuit 183, and generates a sampling clock signal Sc which is a clock signal with a constant frequency to calculate the sampling number m. The generated sampling clock signal Sc is output to the peak hold part 253, and the calculated sampling number m is output to the control unit 103.

The sampling clock generation unit 243 comprises an address counter 243*a* for counting the clock number of the generated sampling clock signal Sc, and an address 0count number M (number of addresses counted) is output to the control unit 103.

Preferably, the period of the sampling clock signal Sc is set with the number of sampling data, the capacity of the storing unit 143, the data collection function and the like optimized. When the period is shortened and the sampling number is increased, it may increase the case to read the same data continuously, and may make the read time of the data from the storing unit 143 long, which may result in long nozzle clogging judging operations.

Therefore, the period of the sampling clock signal Sc can be calculated depending upon the sampling time period Ts of the sampling start signal Ss. For example, in a case of a head of piezo system, when the sampling time period Ts is set to be twice of the "ON waveform" time period $T_{on}$, the sampling clock signal Sc with a period of one tenth of the "ON waveform" time period $T_{on}$ can be calculated.

The peak hold part 253 extracts the piezo vibration signal Sd input from the filter circuit 233 in the sampling time period Ts based on the sampling clock signal Sc input from the sampling clock generation unit 243 for each clock. The extracted piezo vibration signals Sd are subjected to A/D conversion by the A/D conversion circuit 263, and are stored in the memory map 143*a* of the storing unit 143 through the I/F 173 as the detected signal Sd'.

As described above, the piezo vibration signal Sd needs to be detected only in the sampling time period Ts, so that unnecessary signal is not detected, thereby improving detection accuracy of a jet failure of the nozzles.

Figure 24A:
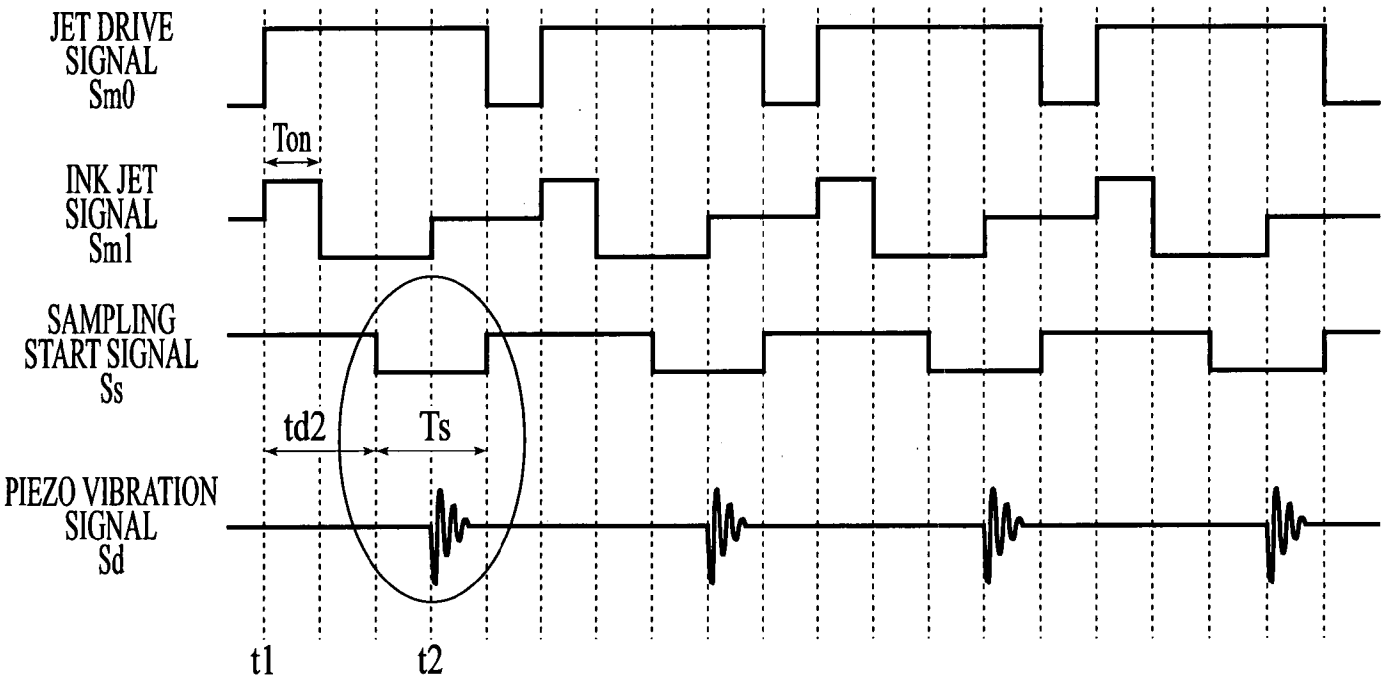
FIG. 24A is an example of a time chart of an ink droplet jetting operation from nozzle jet openings.
Figure 24B:
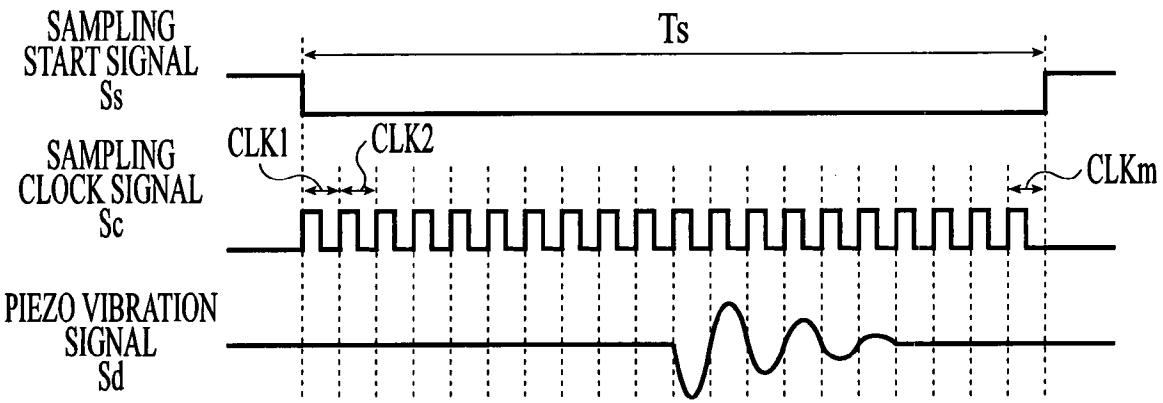
FIG. 24B is an example of a time chart of a sampling start signal $1_h$, a piezo vibration signal Sd, and a sampling clock signal Sc in a sampling period Ts shown in FIG. 24A.

FIGS. 24A and 24B show examples of time charts of ink droplet jetting operations from nozzle jet openings.

FIG. 24A shows the jet drive signal $S_{m0}$ as a signal to instruct the ink droplet jetting operations output to the drive circuit 183 from the CPU 113, the ink jet signal $S_{m1}$ output to the head of the head module 33*a* from the drive circuit 183 based on the jet drive signal $S_{m0}$, the sampling start signal Ss output to the sampling clock generation unit 243 from the drive circuit 183, and the piezo vibration signal Sd output from the piezo film 62 based on the ink jet signal $S_{m1}$.

FIG. 24B shows the sampling start signal Ss, the piezo vibration signal Sd, and the sampling clock signal Sc output to the peak hold part 253 from the sampling clock generation unit 243 in the sampling time period Ts shown in FIG. 24A.

As shown in FIG. 24A, when the jet drive signal $Sm_0$ is output at time t1, the ink jet signal $S_{m1}$ is output. When the delay time $t_{d2}$ passes from the rise time t1 of the jet drive signal $S_{m0}$, the sampling start signal Ss is output. The sampling time period Ts is set to be twice of the "ON waveform" time period $T_{on}$ of the ink jet signal $S_{m1}$ with the rise time t2 of the "OFF waveform" of the ink jet signal $S_{m1}$ as a center. Ink droplets land on the ink droplet landing surface S4 in the sampling time period Ts, so that the piezo vibration signal Sd is output.

As shown in FIG. 24B, in the sampling time period Ts, the sampling clock signal Sc is output based on the sampling start signal Ss, the piezo vibration signal Sd is extracted based on the sampling start signal Ss for each clock, and nozzle clogging judging operation is performed.

Next, description will be made for the nozzle clogging judging operation performed by the control unit 103.

Figure 25:
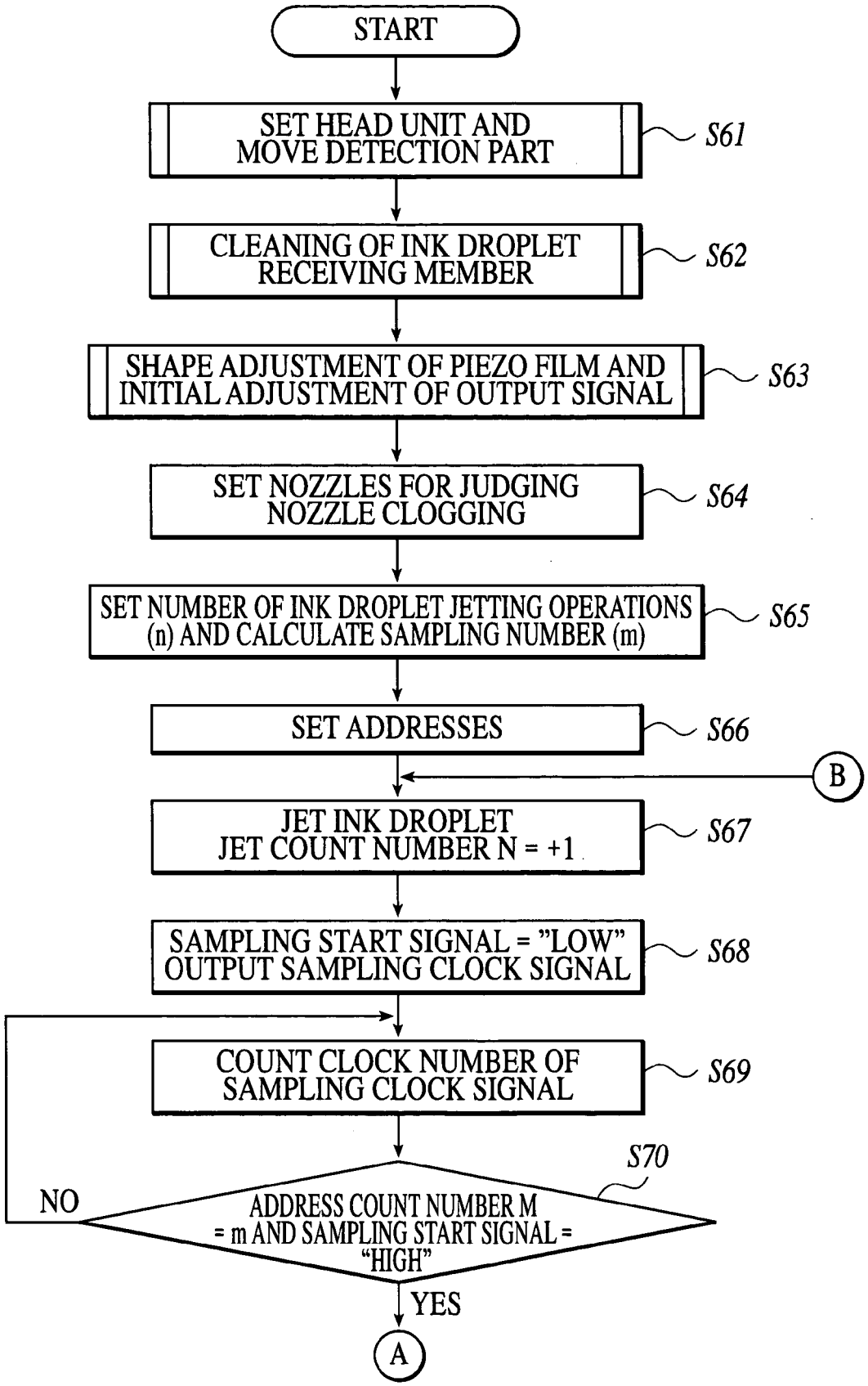
FIG. 25 is a flow chart of the nozzle clogging judging operation in the third embodiment.
Figure 26:
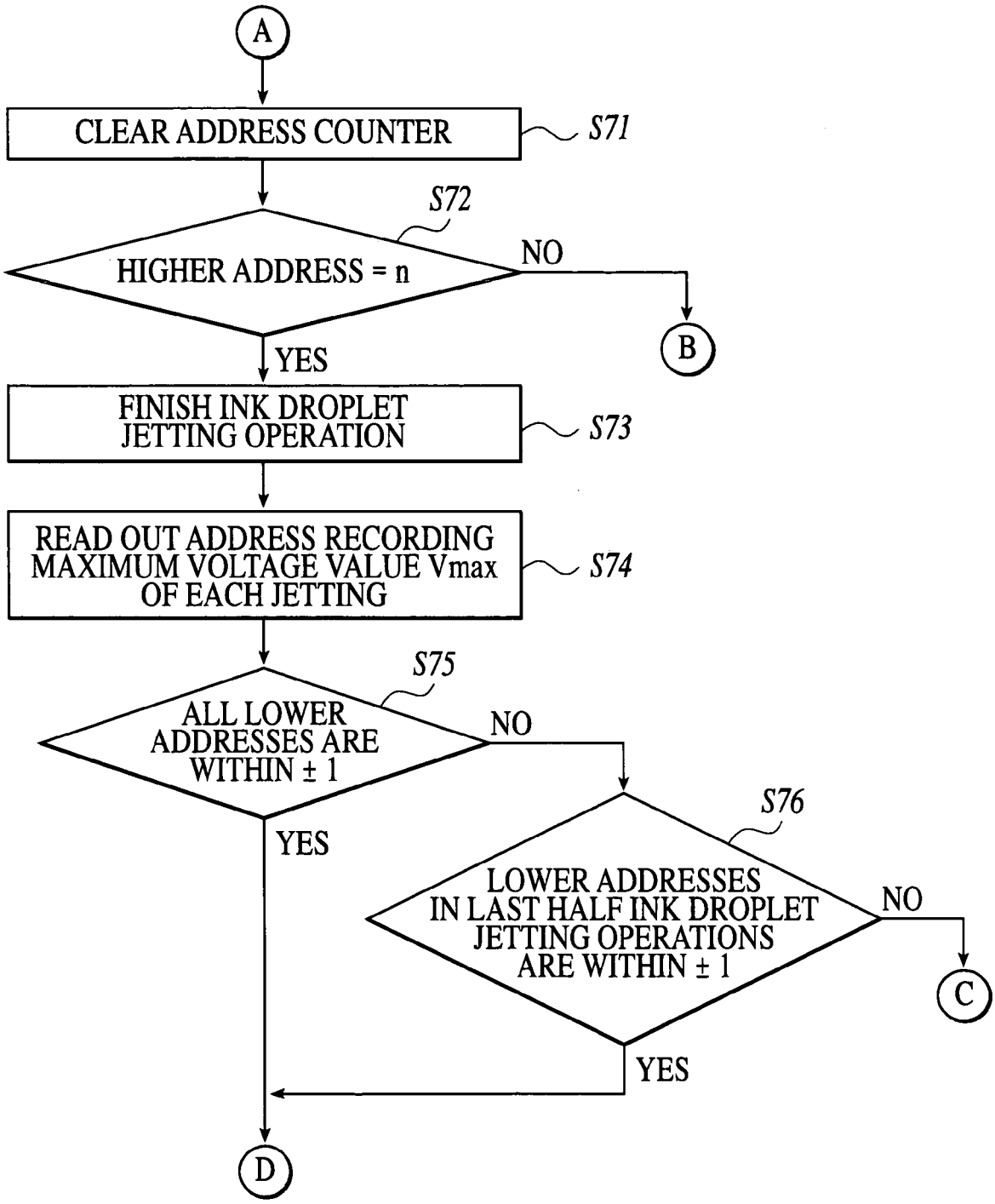
FIG. 26 is a flow chart continuing from FIG. 25 to illustrate the nozzle clogging judging operation in the third embodiment.
Figure 27:
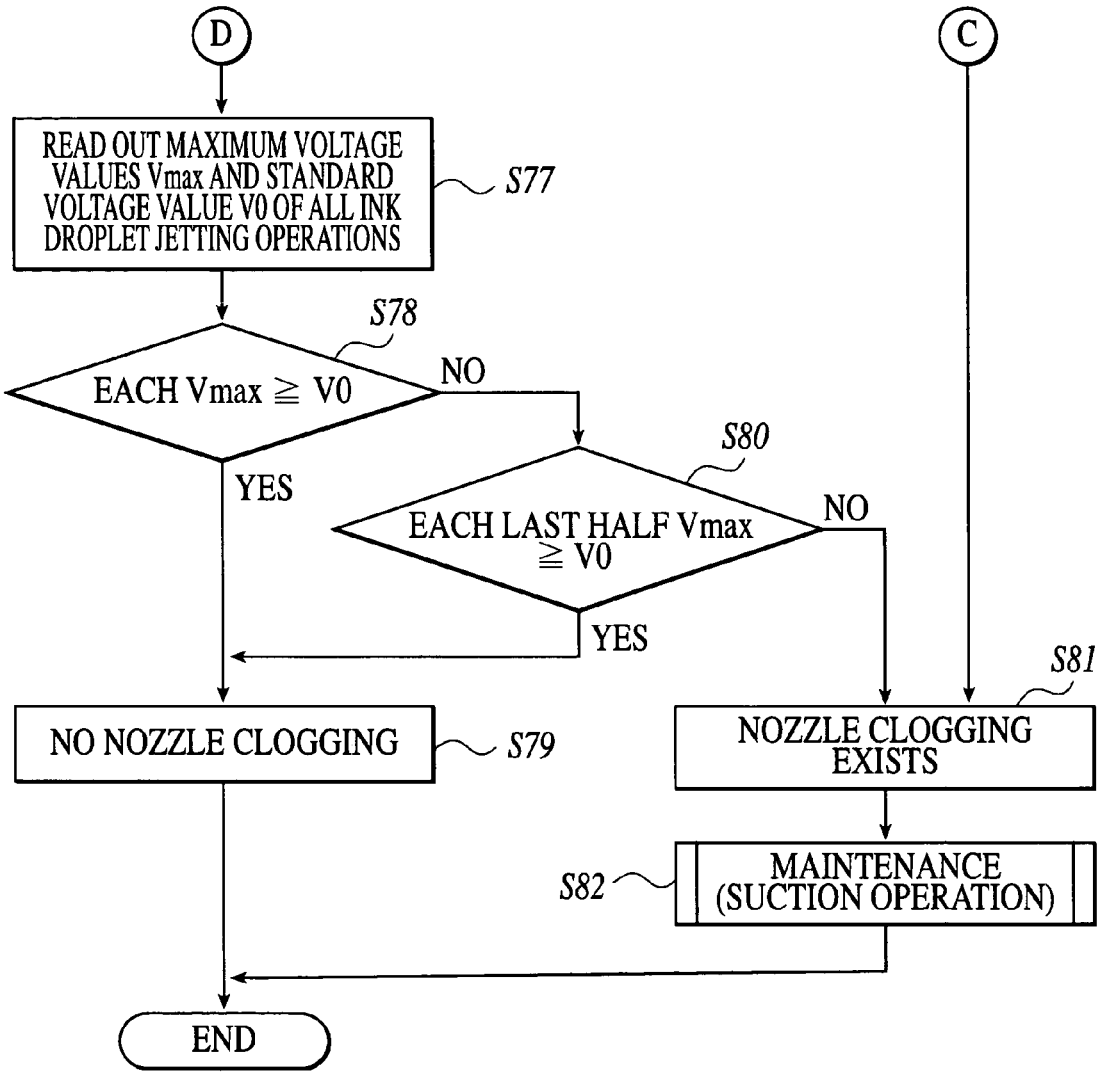
FIG. 27 is a flow chart continuing from FIG. 26 to illustrate the nozzle clogging judging operation in the third embodiment.

FIGS. 25 to 27 show flow charts of the nozzle clogging judging operation of the third embodiment.

The head unit which is subjected to the nozzle clogging judgment is set. Thereafter, the nozzle clogging detection part 603 is moved to a predetermined position below the set head unit (Step S61).

After the nozzle clogging detection part 603 was moved to the predetermined position, cleaning of the ink droplet receiving part 613 is performed, and mechanical vibration of the nozzle clogging detection part 603 is stopped (Step S62).

After the cleaning of the ink droplet receiving part 613, the shape of the piezo film 62 is adjusted. Also, the output signal output from the piezo film 62 is adjusted so that the piezo vibration signal Sd to be output from the piezo film 62 would be constant within the range of the preset initial value (Step S63).

After the initial setting of the output signal from the piezo film 62, nozzles for judging nozzle clogging are set (Step S64).

The number of ink jetting operations n is set by a operating portion or the like, and the sampling number m is calculated based on the sampling time period Ts and the sampling clock signal Sc (Step S65).

In the storing unit 143, addresses are set based on the number of ink jetting operations n and the sampling number m, and the setting of the memory map for storing detected data Sd' is performed (Step S66).

One is added to the jet count number N of the ink jet counter (adding one to a reference upper address), and the ink jet signal $S_{m1}$ is output to the set nozzles to jet ink droplets (Step S67).

After the lapse of the delay time $t_{d2}$, the sampling start signal Ss is output (the sampling start signal Ss is in a "LOW" state), and the sampling clock signal Sc starts to be output (Step S68).

The address counter 243*a* counts a clock number of the sampling clock signal Sc (Step S69).

A maximum voltage value in the piezo vibration signal Sd is detected for each clock of the sampling clock signal Sc, and is subjected to A/D conversion. Thereafter, the piezo vibration signal Sd (that is, a detected data Sd' for each clock) is stored in an appropriate address based on the jet count number N and the address count number M with reference to the addresses in the memory map 143*a*.

A judgment is made whether the value of the reference lower address is equal to the sampling number m (that is, the address count number M is equal to the sampling number m), and the sampling start signal Ss is in a "HIGH" state (Step S70). If these conditions are not satisfied (Step S70; No), the operation is returned to Step S69.

When the address count number M is equal to the sampling number m, and the sampling start signal Ss is in a "HIGH" state (Step S70; Yes), the address counter 243*a* is cleared (that is, the reference lower address is set to "0") (Step S71).

A judgment is made whether the reference upper address is equal to the number of ink droplet jetting operations n (that is, the jet count number N is equal to the number of ink droplet jetting operations n) (Step S72). When the reference upper address is not equal to the number of ink droplet jetting operations n (Step S72; No), the operation is returned to Step S67.

When the reference upper address is equal to the number of ink droplet jetting operations n (Step S72; Yes), the ink droplet jetting operation is finished (Step S73).

The address in which the maximum voltage value $V_{max}$ is stored for each ink droplet jetting operation is read out from the memory map 143*a* (Step S74).

Preferably, there is one lower address in the addresses in each of which the maximum voltage value for each ink droplet jetting operation is stored, however, due to the relationship between the period of the sampling clock signal Sc and that of the piezo vibration signal Sd, there may be a case where a plurality of lower addresses storing the maximum voltage value with the same voltage consecutively exists.

In the third embodiment, a judgment is made whether lower addresses in the addresses read out for the ink droplet jetting operations are either the same or three consecutive numbers. Hereinafter, it is defined as "judging whether the lower addresses are within ±1".

When the lower addresses are within ±1 (that is, one lower address having the same maximum voltage value exists, or three or less consecutive lower addresses have the same maximum voltage value), it can be judged that the maximum voltage value exists in one lower address, or the same maximum voltage value exist in three or less consecutive lower addresses. Thus, a judgment can be made that there is no nozzle clogging. When the lower addresses are not within ±1, it can be judged that there is no address indicating the maximum voltage value, or the same maximum voltage value exists in four or more consecutive lower addresses. Thus, a judgment can be made that there was no vibration or impact by ink droplets, thereby it can be judged that nozzle clogging exists.

In the third embodiment, explanation is made to the case in which the lower addresses are needed to be within ±1, however, it may be within ±2 to 4, that is, it is preferable to set the address number for judging that there is no nozzle clogging based on the address number which would exists considering the relationship between the period of the sampling clock signal and that of the piezo vibration signal.

A judgment is made whether the lower addresses in the addresses read out for all ink droplet jetting operations are within ±1 (Step S75).

When not all the lower addresses in the addresses read out for all ink droplet jetting operations are not within ±1 (Step S75; No), a judgment is made whether the lower addresses in the addresses read out in the last half ink droplet jetting operations are within ±1 (Step S76). When not all the lower addresses in the addresses read out in the last half ink droplet jetting operations are not within ±1 (Step S76; No), the ink droplet jetting operations are judged to be abnormal, therefore, a judgment is made that there is nozzle clogging (Step S81).

When all the lower addresses in the addresses read out in all ink droplet jetting operations or in the last half ink droplet jetting operations are within ±1 (Step S75; Yes, Step S76; Yes), the maximum voltage values $V_{max}$ written in the addresses read out in all ink droplet jetting operations and the standard voltage value $V_0$ stored in the ROM 123 are read out (Step S77).

In the judgmental step (S78) as a judgmental section, a judgment is made whether each maximum voltage value $V_{max}$ of the ink droplet jetting operations which was read out is not less than the standard voltage value $V_0$.

When each maximum voltage value $V_{max}$ is not less than the standard voltage value $V_0$ (Step S78; Yes), the ink droplet jetting operations are judged to be normal, therefore, a judgment is made that there is no nozzle clogging (Step S79).

When not all the maximum voltage values $V_{max}$ are not less than the standard voltage value $V_0$ (Step S78; No), a judgment is made whether each maximum voltage value $V_{max}$ in the last half of the ink droplet jetting operations is not less than the standard voltage value $V_0$ (Step S80).

When each maximum voltage value $V_{max}$ in the last half of the ink droplet jetting operations is not less than the standard voltage value $V_0$ (Step S80; Yes), the ink droplet jetting operations are judged to be normal, and a judgment is made that there is no nozzle clogging (Step S79).

When not all the maximum voltage values $V_{max}$ in the last half of the ink droplet jetting operations are not less than the standard voltage value $V_0$ (Step S80; No), the ink droplet jetting operations are judged to be abnormal, and a judgment is made that nozzle clogging exists (Step S81).

When the judgment was made that nozzle clogging exists, the maintenance operation for solving the nozzle clogging (for example, suction operation or the like) is performed to the head module having the nozzle jet openings which need the maintenance (Step S82).

Ink droplets are jetted from the nozzle jet openings predetermined times, reading out an address of a detected data Sd' indicating the maximum voltage value $V_{max}$ for each ink droplet jetting operation, performing a judgment of nozzle clogging based on the address number which was read out, and further comparing each maximum voltage value $V_{max}$ shown by the detected data Sd' corresponding to each address which was read out with the standard voltage value $V_0$. When not all the maximum voltage values $V_{max}$ are not less than the standard voltage value $V_0$, a judgment is made that ink droplets are not jetted from the set nozzle jet openings (that is, nozzle clogging exists). Further, due to the structural feature of the ink jet head, there is a case that ink jetting is not performed for the initial stage of the ink droplet jetting operations, and is started after repeating ink droplet jetting operation for a few times, so that ink droplets are jetted in the last half ink droplet detection operations to detect the maximum voltage values $V_{max}$. Even in such the case, a judgment can be made that there is no nozzle clogging, thereby enabling to properly performing the maintenance operation only in the case when the maintenance operation is needed.

Accordingly, the landing of in droplets can be detected by using a vibration detection section (for example, piezo film) with high accuracy, and nozzle clogging can be detected with easy structure. This results in a decrease of the cost for the apparatus.

The entire disclosure of Japanese Patent Application Nos. Tokugan 2004-5338 which was filed on Jan. 13, 2004, Tokugan 2004-6961 which was filed on Jan. 14, 2004, and Tokugan 2004-48076 which was filed on Feb. 24, 2004, including specification, claims, drawings and summary are incorporated herein by reference in its entirety.

What is claimed is:

1. An ink jet printer comprising:

an ink jet section for jetting ink from nozzles:

a vibration detection section for detecting a jet failure of the nozzles, which is provided ahead in an ink droplet jetting direction from the nozzles;

an ink droplet receiving section for receiving an ink droplet jetted from the nozzles, which is interposed between the nozzles and the vibration detection section; and a control section for controlling a maximum diameter of an ink droplet jetted from the nozzles when detecting a jet failure of the nozzles to be larger than that of an ink droplet jetted from the nozzles when recording an image, wherein the ink droplet landing surface of the ink droplet receiving section comprises a plurality of channels which are parallel to one another, and the control section controls the maximum diameter of the ink droplet jetted from the nozzles to be not larger than a width of each of the channels.

2. The printer of claim 1, wherein each of the channels is opened at least on one end side in an longitudinal direction, and an opened portion of the one end side in the longitudinal direction is inclined to be positioned lower than an other end side of each of the channels in a vertical direction.

3. The printer of claim 1, wherein an arrangement pitch of the channels is equal to that of the nozzles.

4. The printer of claim 1, wherein the ink droplet receiving section is provided to make a bottom portion of one of the channels corresponds to a landing position of an ink droplet from the nozzles.

5. An ink jet printer comprising:

an ink jet section for jetting ink from nozzles;

a vibration detection section for detecting a jet failure of the nozzles, which is provided ahead in an ink droplet jetting direction from the nozzles;

an ink droplet receiving section for receiving an ink droplet jetted from the nozzles, which is interposed between the nozzles and the vibration detection section;

a control section for controlling a maximum diameter of an ink droplet jetted from the nozzles when detecting a jet failure of the nozzles to be larger than that of an ink droplet jetted from the nozzles when recording an image;

a sampling section for generating a sampling signal which is delayed from an ink jet signal for jetting an ink droplet from the nozzles for a predetermined time, and extracting a sampling detection signal output from the vibration detection section when an ink droplet lands based on the sampling signal; and a judging section for judging a jet failure of the nozzles based on the sampling detection signal extracted by the sampling section.

6. The printer of claim 5, wherein the judging section compares a maximum voltage value of the sampling detection signal with a preset standard voltage value, and judges that a jet failure exists when the maximum voltage value of the sampling detection signal is lower than the standard voltage value.

7. The printer of claim 5, wherein the judging section compares the number of ink droplet jetting operations with the number which is counted when a voltage value of the sampling detection signal is not less than the standard voltage value, and judges that a jet failure exists when both the numbers are not equal.

8. The printer of claim 5, wherein the judging section compares an output cycle of the sampling detection signal with an output cycle of the ink jet signal, and judges that a jet failure exists when both the cycles are not equal.

9. An ink jet printer comprising:

an ink jet section for jetting ink from nozzles;

a vibration detection section for detecting a jet failure of the nozzles, which is provided ahead in an ink droplet jetting direction from the nozzles;

an ink droplet receiving section for receiving an ink droplet jetted from the nozzles, which is interposed between the nozzles and the vibration detection section; and a control section for controlling a maximum diameter of an ink droplet jetted from the nozzles when detecting a jet failure of the nozzles to be larger than that of an ink droplet jetted from the nozzles when recording an image, wherein the vibration detection section comprises a strain gage which converts a mechanical displacement to an electrical charge.

10. An ink jet printer comprising:

an ink jet section for jetting ink from nozzles;

a vibration detection section for detecting a jet failure of the nozzles, which is provided ahead in an ink droplet jetting direction from the nozzles;

an ink droplet receiving section for receiving an ink droplet jetted from the nozzles, which is interposed between the nozzles and the vibration detection section; and a control section for controlling a maximum diameter of an ink droplet jetted from the nozzles when detecting a jet failure of the nozzles to be larger than that of an ink droplet jetted from the nozzles when recording an image, wherein the vibration detection section comprises a film shaped piezoelectric element which converts a mechanical displacement to an electrical charge; and wherein the film shaped piezoelectric element is curved into an approximately half cylindrical shape, and is disposed to make a maximum projecting portion of a curved outer periphery thereof face an ink droplet coming direction of the ink droplet.

11. The printer of claim 10, wherein the film shaped piezoelectric element is supported by a position adjusting section for adjusting the maximum projecting portion of the curved outer periphery to a landing position of the ink droplet jetted.

12. The printer of claim 11, wherein the position adjusting section allows one end side of the film shaped piezoelectric element in a curving direction to move to be close to or separated from an other end thereof which is fixed, and adjusts the maximum projecting portion of the curved outer periphery to the landing position of the ink droplet jetted.

13. The printer of claim 11, wherein the position adjusting section allows one end side of the film shaped piezoelectric element in a curving direction and an other end side thereof to move in parallel in a same direction with an interval therebetween kept constant, and adjusts the maximum projecting portion of the curved outer periphery to the landing position of the ink droplet jetted.

14. The printer of claim 11, wherein the position adjusting section allows one end side of the film shaped piezoelectric element in a curving direction and an other end side thereof to relatively move to be close to or separated from each other, and adjusts the maximum projecting portion of the curved outer periphery to the landing position of the ink droplet jetted.

15. An ink jet printer comprising:

an ink jet section for jetting ink from nozzles;

a vibration detection section for detecting a jet failure of the nozzles, which is provided ahead in an ink droplet jetting direction from the nozzles;

an ink droplet receiving section for receiving an ink droplet jetted from the nozzles, which is interposed between the nozzles and the vibration detection section; and a control section for controlling a maximum diameter of an ink droplet jetted from the nozzles when detecting a jet failure of the nozzles to be larger than that of an ink droplet jetted from the nozzles when recording an image, wherein the vibration detection section comprises a film shaped piezoelectric element which converts a mechanical displacement to an electrical charge; and wherein the ink droplet receiving section comprises a projecting portion, which is provided at a position to face a maximum projecting portion of a curved outer periphery of the film shaped piezoelectric element, for transmitting an impact force generated when an ink droplet lands to the maximum projecting portion.

16. An ink jet printer comprising:

an ink jet section for jetting ink from nozzles;

a vibration detection section for detecting a jet failure of the nozzles, which is provided ahead in an ink droplet jetting direction from the nozzles;

an ink droplet receiving section for receiving an ink droplet jetted from the nozzles, which is interposed between the nozzles and the vibration detection section: and a control section for controlling a maximum diameter of an ink droplet jetted from the nozzles when detecting a jet failure of the nozzles to be larger than that of an ink droplet jetted from the nozzles when recording an image, wherein the vibration detection section comprises a film shaped piezoelectric element which converts a mechanical displacement to an electrical charge; and wherein the ink jet section comprises a plurality of nozzle groups arranged without overlapping with one another in a main scanning direction, each of the plurality of nozzle groups having a set of nozzles disposed at a predetermined interval along a direction diagonally crossing a sub scanning direction, and a plurality of channels, each of which starts from a landing position of an ink droplet jetted from the nozzles and ends at one end of an ink droplet landing surface, is formed on the ink droplet landing surface of the ink droplet receiving section to correspond to an arrangement interval of the nozzles.

17. The printer of claim 16, wherein each of the channels is opened at one end side in an longitudinal direction, and an opened portion of the one end side in the longitudinal direction is inclined to be positioned lower than an other end side of each of the channels in a vertical direction.

18. The printer of claim 16, wherein an arrangement pitch of the channels is equal to that of the nozzles.

19. The printer of claim 16, wherein the ink droplet receiving section is provided to make a bottom portion of one of the channels corresponds to a landing position of an ink droplet from the nozzles.

20. The printer of claim 16, wherein the ink droplet receiving section is provided to transmit an impact force generated when an ink droplet jetted lands to the film shaped piezoelectric element.

21. The printer of claim 16, wherein the film shaped piezoelectric element is curved into an approximately half cylindrical shape, and is disposed to make a maximum projecting portion of a curved outer periphery thereof face an ink droplet coming direction of an ink droplet jetted from a nozzle line which is positioned in a middle portion of the ink jet section in a sub scanning direction.

22. The printer of claim 21, wherein the film shaped piezoelectric element is supported by a position adjusting section for adjusting the maximum projecting portion of the curved outer periphery to a landing position of the ink droplet jetted.

23. The printer of claim 22, wherein the position adjusting section allows one end side of the film shaped piezoelectric element in a curving direction to move to be close to or separated from an other end thereof which is fixed, and adjusts the maximum projecting portion of the curved outer periphery to the landing position of the ink droplet jetted from the nozzle line which is positioned in the middle portion of the ink jet section in the sub scanning direction.

24. The printer of claim 22, wherein the position adjusting section allows one end side of the film shaped piezoelectric element in a curving direction and an other end side thereof to move in parallel in a same direction with an interval therebetween kept constant, and adjusts the maximum projecting portion of the curved outer periphery to the landing position of the ink droplet jetted from the nozzle line which is positioned in the middle portion of the ink jet section in the sub scanning direction.

25. The printer of claim 22, wherein the position adjusting section allows one end side of the film shaped piezoelectric element in a curving direction and an other end side thereof to relatively move to be close to or separated from each other, and adjusts the maximum projecting portion of the curved outer periphery to the landing position of the ink droplet jetted from the nozzle line which is positioned in the middle portion of the ink jet section in the sub scanning direction.

26. The printer of claim 16, wherein the ink droplet receiving section comprises a projecting portion, which is provided at a position to face a maximum projecting portion of a curved outer periphery of the film shaped piezoelectric element, for transmitting an impact force generated when an ink droplet lands to the maximum projecting portion.

27. An ink jet printer comprising:

an ink let section for letting ink from nozzles;

a vibration detection section for detecting a jet failure of the nozzles, which is provided ahead in an ink droplet jetting direction from the nozzles;

an ink droplet receiving section for receiving an ink droplet jetted from the nozzles, which is interposed between the nozzles and the vibration detection section: and a control section for controlling a maximum diameter of an ink droplet jetted from the nozzles when detecting a jet failure of the nozzles to be larger than that of an ink droplet jetted from the nozzles when recording an image, wherein the vibration detection section is for outputting a detection signal with an amplitude corresponding to a vibration when the ink droplet lands, and further comprising:

a sampling section for sampling an amplitude value of the detection signal by a predetermined sampling clock signal;

a storing section for storing an amplitude-value data of the detection signal which was sampled by the sampling section; and a judging section for judging a jet failure of the nozzles based on the amplitude value data of the detection signal stored in the storing section.

28. The printer of claim 27, wherein the sampling section comprises a sampling time period having a predetermined time width from a time which is delayed from a generation time of an ink jet signal for jetting the ink by a time it takes for the ink to land on the detection section.

29. The printer of claim 27, wherein the storing section stores the amplitude value data in a memory map comprising addresses which are based on the number of ink droplet jetting operations from the nozzles and a clock number of the sampling clock number.

30. The printer of claim 27, wherein the judging section reads out an address of the amplitude value data showing a maximum amplitude value in each ink droplet jetting operation from the nozzles, and judges a jet failure of the nozzles based on an address number which was read out.

31. The printer of claim 30, wherein the judging section compares a value of the amplitude value data corresponding to the address which was read out with a preset standard value, and judges that the jet failure exists when the value of the amplitude value data is lower than the standard value.

* * * * *